US007409996B2

(12) United States Patent
Myerley et al.

(10) Patent No.: US 7,409,996 B2
(45) Date of Patent: Aug. 12, 2008

(54) CONTROL SYSTEM COMMUNICATION AND LOCK OPEN TOOL AND METHOD FOR LOCKING OPEN A SAFETY VALVE AND COMMUNICATING WITH SURFACE

(75) Inventors: Thomas S. Myerley, Broken Arrow, OK (US); Scott C. Strattan, Tulsa, OK (US)

(73) Assignee: Baker Hughes Incorporated, Houston, TX (US)

( * ) Notice: Subject to any disclaimer, the term of this patent is extended or adjusted under 35 U.S.C. 154(b) by 267 days.

(21) Appl. No.: 10/973,015

(22) Filed: Oct. 25, 2004

(65) Prior Publication Data

US 2005/0098325 A1 May 12, 2005

Related U.S. Application Data

(60) Provisional application No. 60/514,946, filed on Oct. 28, 2003, provisional application No. 60/514,883, filed on Oct. 27, 2003.

(51) Int. Cl.
*E21B 34/10* (2006.01)

(52) U.S. Cl. ..... 166/323; 166/373; 166/332.8

(58) Field of Classification Search ..... 166/386, 166/322, 321, 323, 373, 332.8
See application file for complete search history.

(56) References Cited

U.S. PATENT DOCUMENTS

| | | | |
|---|---|---|---|
| 3,111,989 | A | 11/1963 | Tamplen |
| 3,301,337 | A | 1/1967 | Vaughn et al. |
| 3,696,868 | A | 10/1972 | Taylor, Jr. |
| 3,763,932 | A | 10/1973 | Dinning |
| 3,786,865 | A | 1/1974 | Tausch et al. |
| 3,786,866 | A | 1/1974 | Tausch et al. |
| 3,799,258 | A | 3/1974 | Tausch |
| 3,981,358 | A | 9/1976 | Watkins et al. |
| 4,077,473 | A | 3/1978 | Watkins |
| 4,161,960 | A | 7/1979 | Watkins |
| 4,165,784 | A | 8/1979 | Gardner |
| 4,201,363 | A | 5/1980 | Arendt et al. |
| 4,215,748 | A | 8/1980 | Pace et al. |
| 4,273,194 | A | 6/1981 | Pringle et al. |
| 4,310,048 | A | 1/1982 | Mott |

(Continued)

FOREIGN PATENT DOCUMENTS

WO WO 2004/031535 A1 9/2003

*Primary Examiner*—Jennifer H Gay
*Assistant Examiner*—Brad Harcourt
(74) *Attorney, Agent, or Firm*—Cantor Colburn LLP

(57) ABSTRACT

Disclosed herein is a communication and lock open device which includes a lock open portion including a latch configured to engage a shifting profile on a closure member of a safety valve. Further included is a communication portion configured to rotationally align a cutter with a non-annular hydraulic bore in the safety valve and axially cut into the hydraulic bore with the cutter. Also disclosed is a method for replacing the function of a safety valve while employing an original control line including running a communication and lock open tool in a wellbore, locating the tool in a tubing retrievable safety valve and shearing a thread in the valve to render moveable a closure member of the tubing retrievable safety valve. The method includes shifting the closure member to lock the member in an open position, orienting a cutter and establishing fluid communication with a bore of the valve.

21 Claims, 43 Drawing Sheets

U.S. PATENT DOCUMENTS 4,319,639 A 3/1982 Mott
4,344,602 A 8/1982 Arendt
4,356,867 A 11/1982 Carmody
4,406,325 A 9/1983 Bowyer ..... 166/214
4,411,316 A 10/1983 Carmody
4,420,041 A 12/1983 Patel ..... 166/278
4,449,587 A 5/1984 Rodenberger et al.
4,475,599 A 10/1984 Akkerman
4,542,792 A 9/1985 Akkerman
4,574,889 A 3/1986 Pringle
4,577,694 A 3/1986 Brakhage, Jr.
4,603,740 A 8/1986 Edwards et al.
4,605,070 A 8/1986 Morris
4,606,410 A 8/1986 Becker et al.
4,607,710 A * 8/1986 Radford ..... 175/249
4,624,315 A 11/1986 Dickson et al.
4,723,606 A 2/1988 Vinzant et al.
4,796,705 A 1/1989 Carmody et al.
4,944,351 A 7/1990 Eriksen et al.
4,951,753 A 8/1990 Eriksen
4,967,845 A 11/1990 Shirk ..... 166/386
4,981,177 A 1/1991 Carmody et al.
5,127,476 A 7/1992 Dickson et al.
5,165,480 A 11/1992 Wagoner et al.
5,167,284 A 12/1992 Leismer
5,226,483 A 7/1993 Williamson, Jr.
5,249,630 A 10/1993 Meaders et al.
5,263,847 A 11/1993 Akkerman et al.
5,293,943 A 3/1994 Williamson, Jr.
5,314,026 A 5/1994 Williamson, Jr.
5,343,955 A 9/1994 Williams
5,353,876 A * 10/1994 Curington et al. ..... 166/313
5,496,044 A 3/1996 Beall et al.
5,564,675 A 10/1996 Hill, Jr. et al.
5,575,331 A 11/1996 Terrell
5,598,864 A 2/1997 Johnston et al.
5,799,949 A 9/1998 Beall et al.
5,810,087 A * 9/1998 Patel ..... 166/373
6,059,041 A 5/2000 Scott
6,173,785 B1 1/2001 Adams et al.
6,209,652 B1 4/2001 Portman et al.
6,260,850 B1 7/2001 Beall et al.
6,273,187 B1 8/2001 Voisin, Jr. et al.
6,283,477 B1 9/2001 Beall et al.
6,352,118 B1 3/2002 Dickson et al.
6,433,991 B1 8/2002 Deaton et al.
6,523,614 B2 2/2003 Dennistoun et al.
6,619,388 B2 9/2003 Dietz et al.
6,659,185 B2 12/2003 Dennistoun et al.
6,742,595 B2 6/2004 Dennistoun et al.
6,902,006 B2 * 6/2005 Myerley et al. ..... 166/373
2003/0070817 A1 4/2003 Dennistoun et al. ..... 166/386
2003/0173089 A1 9/2003 Westgaud et al.
2004/0026087 A1 2/2004 Dennistoun et al.
2004/0065442 A1 * 4/2004 Myerley et al. ..... 166/373

* cited by examiner

CONTROL SYSTEM COMMUNICATION AND LOCK OPEN TOOL AND METHOD FOR LOCKING OPEN A SAFETY VALVE AND COMMUNICATING WITH SURFACE

CROSS-REFERENCE TO RELATED APPLICATIONS

This application claims priority to U.S. Ser. No. 60/514,946 filed Oct. 28, 2003, the entire disclosure of which is incorporated herein by reference and U.S. Ser. No. 60/514,883 filed Oct. 27, 2003, the entire contents of which is incorporated herein by reference.

BACKGROUND

In the hydrocarbon exploration and recovery arts it is often desirable to employ valves in the downhole environment to control the migration of fluids. In some cases these valves include a closure member that is positionable across a flow area of a tubing string to shut in the wellbore below the closure member. Such valves are often called safety valves. Tubing retrievable safety valve(s) (TRSV) are commercially available from Baker Oil Tools, Houston, Tex., under part number H826103110. These valves have been extensively and reliably employed all over the world. Due to harsh conditions downhole however, all downhole components have limited life spans. When a TRSV fails to operate at optimum, cost associated with profitable hydrocarbon recovery can rise. In such cases, it is desirable to lock the original TRSV open and provide for communication with, and thus control over, a wireline run safety valve to be installed to assume the function of the original TRSV. Devices configured to provide such communication are known to the art but each has drawbacks. Advancements in the art are always beneficial and well received.

SUMMARY

Disclosed herein is a communication and lock open device. The device includes a lock open portion including a latch configured to engage a shifting profile on a closure member of a safety valve. The device further includes a communication portion configured to rotationally align a cutter with a non-annular hydraulic bore in the safety valve and axially cut into the hydraulic bore with the cutter.

Further disclosed herein is a selective collet which includes a sleeve having one or more fingers, at least one of the fingers having an attachment feature and an upset extending radially outwardly of the sleeve. The sleeve further includes a latch hold down engageable with a latch to prevent engagement thereof with another structure.

Also disclosed herein is a tubing retrievable safety valve that includes a housing, a flow tube mounted at the housing, a closure member mounted at the housing by a selectively shearable thread, the closure member operable responsive to the flow tube, a biasing member in operable communication with the flow tube, and a hydraulic control fluid in pressurizable communication with the flow tube.

Also disclosed herein is a method for replacing the function of a tubing retrievable safety valve while employing an original control line including running a communication and lock open tool in a wellbore, locating the tool in a tubing retrievable safety valve and shearing a thread in the tubing retrievable safety valve to render longitudinally moveable a closure member of the tubing retrievable safety valve. The method further includes shifting the closure member to lock the member in an open position, orienting a cutter and longitudinally establishing fluid communication with a piston bore of the tubing retrievable safety valve.

BRIEF DESCRIPTION OF THE DRAWINGS

Referring now to the drawings wherein like elements are numbered alike in the several Figures.

DETAILED DESCRIPTION

Figure 1A:
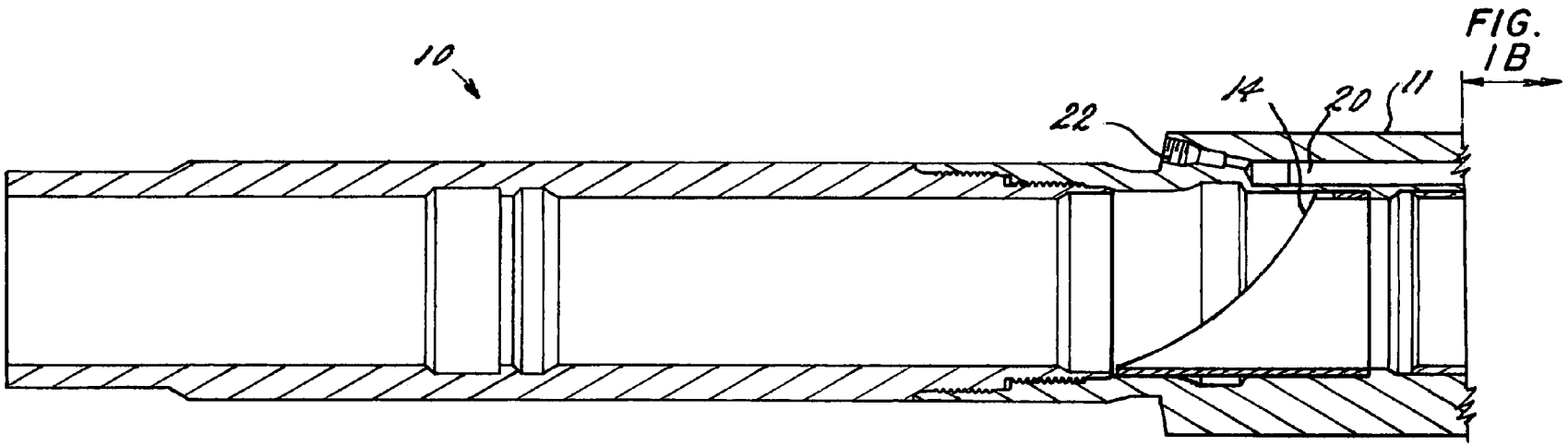
FIGS. 1A-C are a cross-sectional view of a TRSV modified slightly from the commercial embodiment identified in the background section of this application.
Figure 1B:
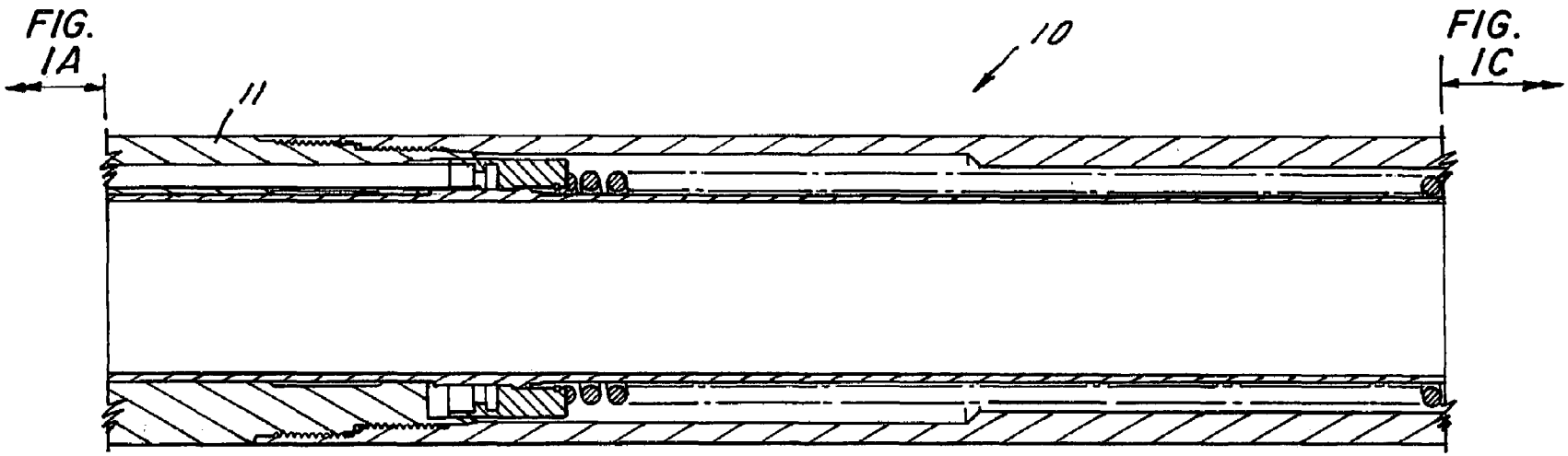
Figure 1C:
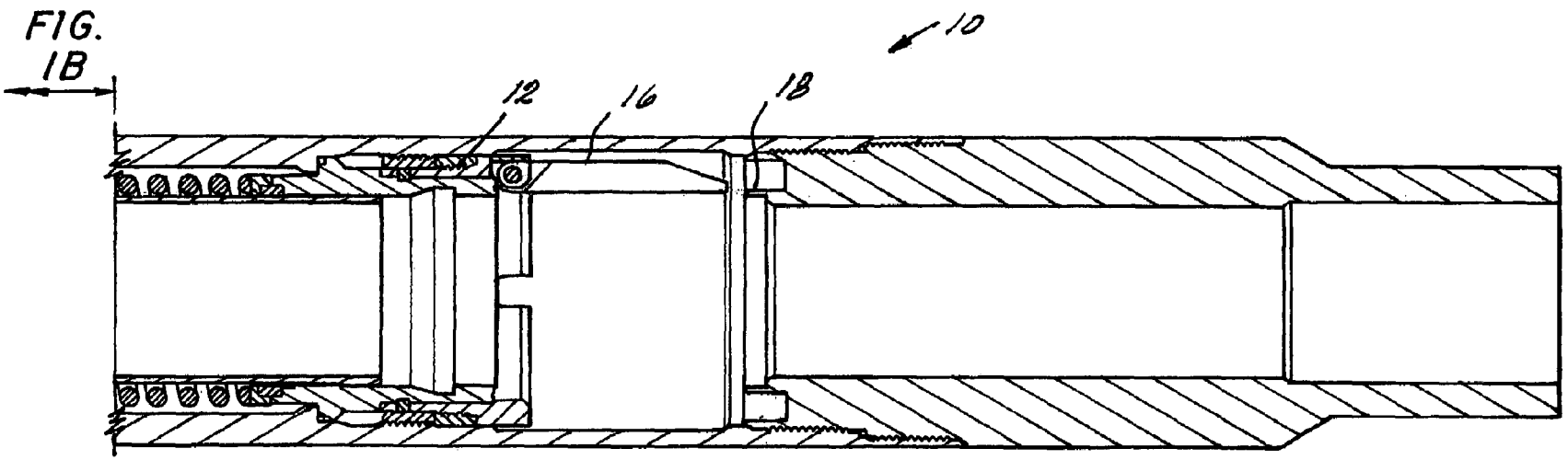
Figure 3A:
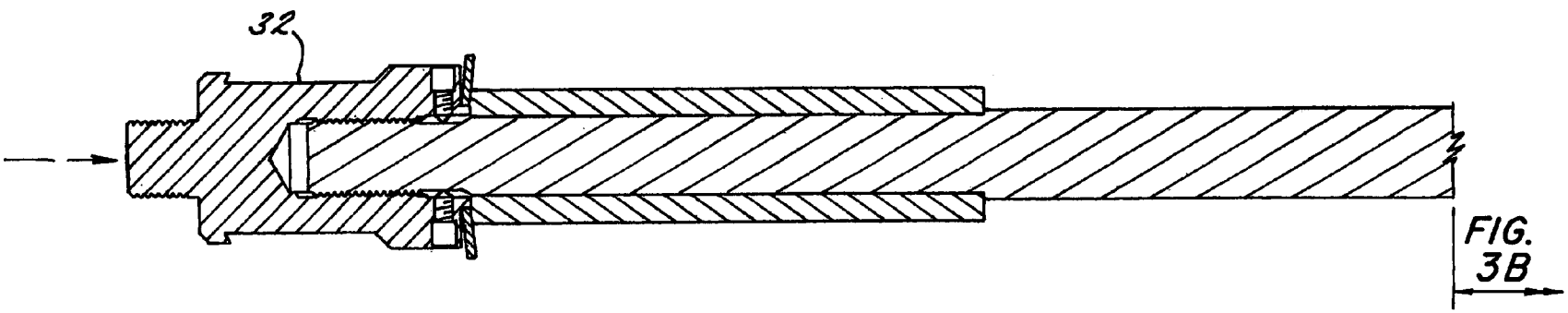
Figure 3B:
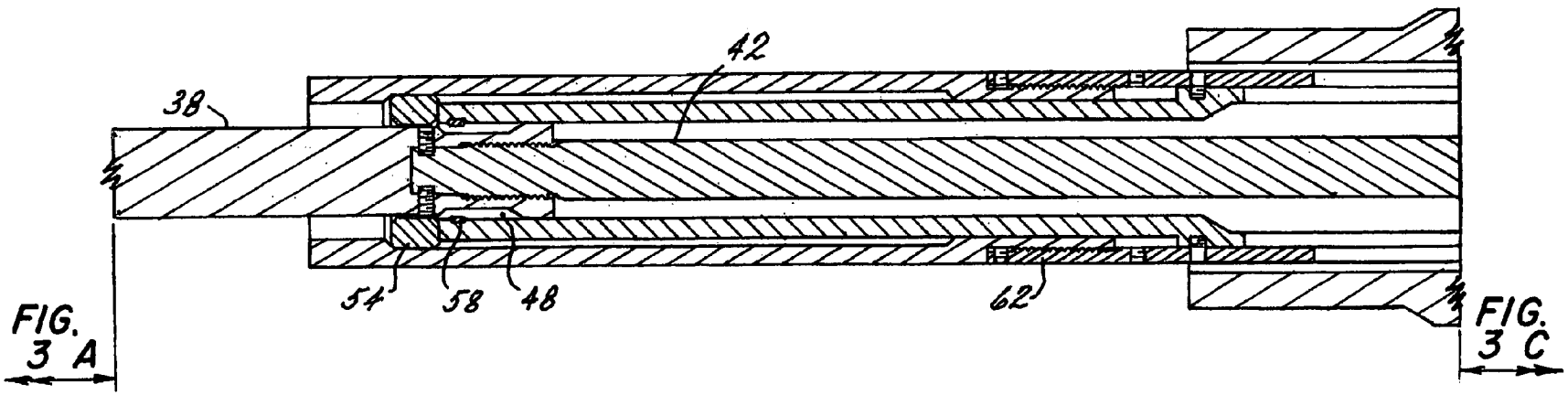

Referring to FIGS. 1A-C, one of skill in the art should recognize most of the components of the TRSV 10 illustrated. These are not discussed specifically herein other than incidentally to the discussion of the communication and lock open tool and with respect to features of the TRSV that are themselves new. Components of the illustrated TRSV that are distinct from the commercially available TRSV and do represent a portion of the invention includes a thread 12 and a profile 14. Thread 12 is not visibly changed from the prior art TRSV but is indeed modified. Thread 12 is in one embodiment, constructed as a narrow cross-section thread (about ½ thickness of standard square thread profile for example). The thread may be made from an alloy such as nickel alloy and may be annealed to a specified yield strength (lower than mating parts). Further, in some applications, sections of the thread are removed (milled from substantially to completely through from inside dimension to outside dimension) to achieve the desired shear value. Any shear valve can be obtained. This also accommodates the disassembly of the tool to allow removal of the sheared part. Upon shearing, the flapper (closure member) 16 is longitudinally moveable relative to the TRSV housing 11. By shifting (moving) the flapper relative to housing 11, to a location where part of the flapper is behind a lock tab 18 in the TRSV 10. The flapper 16 is no longer closeable and is thus locked open. It is noted that the shear strength of the thread 12 is selected to be equivalent in strength to any and all of the other commercial components of the flapper assembly. This prevents unintended shearing and related problems.

As noted above, another new addition to the commercial TRSV is profile 14. The profile itself is relevant to the function described herein and not what supports that profile. In the illustrated embodiment, profile 14 is occasioned by a sleeve 104, but it could easily be an integral portion of housing 11 of TRSV 10, if desired. The purpose of profile 14 is to orient an alignment device such as an alignment collet, which orients a cutter, which is part of the communication and lock open tool discussed further hereunder. Profile 14 ensures that the cutter will create communication by cutting into a non-annular hydraulic chamber comprising a piston bore 20 (hydraulic chamber) of the original TRSV 10. It will be appreciated by one of ordinary skill in the art that original piston bore 20 is fluidly connected to a control line 22, commonly hydraulic, that is in operable communication with a control location, which may be remote, and may be a surface location. By cutting into piston bore 20, the communication medium employed by piston bore 20 (e.g., hydraulic fluid) is available at an inside dimension of the TRSV 10 and therefore available to communicate with an after-installed replacement valve such as a wireline retrievable safety valve (WRSV). Such communication with the after-installed valve means that the after-installed valve is controllable from the original remote or surface location using the original control line 22.

Referring to FIGS. 2A-G, the communication and lock open device 30 described herein is illustrated disposed at an inside dimension of the TRSV 10 in a non-actuated condition, having been run there on a suitable string (not shown) due to a desire to replace the function of TRSV 10. Device 30 comprises many components that cooperate with one another and move relative to one another in a predetermined sequence wherein components, for example, at an uphole end of device 30 and a more downhole portion of device 30 may actuate simultaneously or in sequence. For clarity, the interconnection of the various components is described first, with operation of those components only alluded to where such allusion provides for better understanding. A detailed description of the operation of device 30 follows this initial component description. In connection with the component description, reference, to FIGS. 2A-G is largely sufficient without reference to other figures. It is pointed out however that due to movement of the tool, some figures may make viewing some components easier. Components are numbered in each of the drawings to avoid any ambiguity. Reference to other of the drawings may be helpful.

Beginning at the uphole end of the device 30 (at the left of the drawings) a fishing neck 32 is in communication with an upper shaft sleeve 34. Fishing neck 32 also includes at a downhole end thereof a spring washer 36 for decreasing impact force when the tool is fully stroked. Fishing neck 32 is threadedly connected to upper shaft 38 at thread 40. Upper shaft 38, at a downhole end thereof is threadedly connected to shaft 42 at thread 44. In order to prevent the unintentional unmating of thread 44, one or more set screw(s) 46 are employed in one embodiment. On an outside dimension of upper shaft 38, near thread 44 (which is on an inside dimension of the upper shaft), is dog recess 48 having beveled edges 50. Edges 50 communicate with beveled edges 52 on dogs 54. Dogs 54 communicate with upper latch mandrel 56. Upper latch mandrel 56 further includes an upper C-ring 58 and extends in a downhole direction to one or more shear screw(s) 60. Shear screw(s) 60, releasably affix upper latch mandrel 56 to upper latch collet 62 which is threadedly connected to upper latch extension 64 through thread 66 and set screws 68. Upper latch extension 64 includes on its inside dimension, a recess (or plurality of recesses) 70 to receive a portion of dogs 54 during actuation of the device 30.

Upper latch collet 62 extends in a downhole direction to culminate at collet profile 72, which is configured to engage a lock profile 74 in the TRSV 10. It will be appreciated that lock profile 74 includes a shoulder 76 that provides a no-go when combined with shoulder 78 on collet profile 72. In one embodiment, the shoulders are reverse cut to hold without support for a position of the operation. Collet profile 72 is supported in engaged condition with lock profile 74 by latch support 80 when the device 30 is actuated. Support is provided by surface 82 of latch support 80. It will be appreciated that approach ramp 84 assists in allowing movement of latch support 80 to the support position under collet profile 72.

Device 30 may be run selectively or non-selectively with respect to the action of upper latch collet 62. This is occasioned by selective collet 81 having an upset 83, a collet attachment 85 and latch collet hold down 87. Attachment 85 communicates with recess 91 in latch mandrel 56 in one of two ways. One way is that attachment 85 is engaged with recess 91 ab initio and the tool is not in selective engagement mode. The second is that attachment 85 is not engaged with recess 91. In this configuration, latch collet hold down 87 is in communication with the upper latch collet 62 urging collet profile 72 inwardly, which prevents engagement thereof with TRSV profile 74. This configuration would be employed when several TRSVs are in the well, and one deeper than the first is targeted. In the selective mode, the upset 83 is employed to release the collet 62 at the appropriate depth. Since the seal bore in the TRSV is the smallest internal dimension, the upset will catch on it. If it catches on it in an upward movement, the selective collet 81 is moved out of communication with profile 72 and will allow profile 72 to engage the TRSV profile 74. Thus, in use, the device 30 is run to a location just downhole of the target TRSV and then pulled back to selectively engage with that TRSV. Upon actuation of the selective collet 81, the attachment 85 engages recess 91 to prevent later interference of selective collet 81 with the operation of latch collet 56.

Latch support 80 is driven, through shear screw(s) 86, by upper latch mandrel 56. Once latch support 80 is in the desired location, angle surface 88 will shoulder on bevel 90. Subsequent downhole force on upper latch mandrel 56 will shear screw(s) 86.

A downhole end 92 of upper latch mandrel 56 is interengaged with guide 94 (numbered in two places to make extent of component clear). Guide 94 provides support and articulation to cutter retainer 96 and cutter dog 98. Cutter dog 98 includes a bumper 99 to limit radial movement in the illustrated embodiment. Cutter dog 98 is configured to rotate to an aligned position with the non-annular hydraulic piston bore 20, up to about 180° (in one embodiment) while extending cutter blade 100 to a position commensurate with a larger diametral dimension than an outer dimension of device 30 and having a position aligned with and uphole of piston bore 20 in TRSV 10. Cutter dog 98 is configured to cut into piston bore 20 with axial only (as illustrated) or axial and radial movement together (with manipulation of the timing of interaction of the relevant components) coincident axially downward movement of components of device 30 including upper latch mandrel 56 and associated components moveable therewith as discussed hereinabove and detailed hereinbelow.

The movement of cutter dog 98 is caused by profile 102 in a sleeve 104 disposed at an inside dimension of TRSV 10 through alignment collet 108 which includes alignment tab 110. Alignment collet 108 is urged outwardly to follow profile 102 by mandrel 112, which includes frustoconical sections 114 and 116. The two angled frustocones are provided to urge the cutter dog into the cutting position. Two angles are provided as opposed to one for clearance between guide 94 and mandrel 112 to increase initial radial cutter movement, and to ensure radial movement is complete prior to cutting into the bore 20. Mandrel 112 is maintained in position while alignment collet 108 is urged downhole to effect the wedging outward of alignment collet 108. Maintenance of mandrel 112 in place is effected by an uphole end thereof where mandrel 112 is threadably engaged with latch support 80 at thread 118, and set screw(s) 120. Thus mandrel 112 is hung from latch support 80. It is noted that sleeve 104 further includes a slot 106 to positively locate alignment tab 110.

Movement of alignment collet 108 causes movement of guide 94 through alignment collet slides 122 in grooves 124 of guide 94.

A downhole end of guide 94 is axially slidably mounted at cap screw(s) 126 through a downhole end of alignment collet 108 to a collar 128, which slides on mandrel 112 and functions to centralize the collet 108 and guide 94. Guide 94 further includes slot(s) 127 to cooperate with cap screw(s) 126.

Mandrel 112 extends downhole for a distance in one embodiment of about 27 inches to accommodate the length of the flow tube and power spring in the TRSV. A downhole end of mandrel 112 is threadedly connected to inner sleeve 134 through thread 130 and set screw(s) 132. Inner sleeve 134 attaches at a downhole end thereof via shear screw(s) 146 to outer sleeve 148. Outer sleeve 148 is attached at a downhole end thereof to lower latch mandrel 150 through thread 152 and set screw(s) 154. Within mandrel 112, shaft 42 extends downhole beyond the downhole end of mandrel 112 to terminate by threaded connection 136 and set screw(s) 138 to slide 140. Slide 140 is slidingly received in inner sleeve 134. Mounted within inner sleeve 134 is spring pin 142 and downhole end 144 of slide 140. At an inner dimension of slide 140 is lower shaft 156, which is shear screwed 158 to slide 140 at 144. Spring pin 142 slides with slide 140 at recesses 145. Lower shaft 156 continues downhole through lower latch mandrel 150 to a dimensionally enlarged downhole terminus having angled surfaces 160, and 164 which function to urge lower latch collet 162 outwardly at an appropriate time in the actuation sequence described hereunder to engage surface 163 with TRSV shifting profile 165. Surfaces 160 and 164 define a single angled surface interrupted by a machining groove utilized in manufacture of the devices to simplify the same with respect to room for machining.

Threadedly connected to lower shaft 156 via thread 166 and set screw(s) 168 is lower shaft extension 170. Lower shaft extension 170 is disposed within mandrel extension 172 which itself is connected via cap screw(s) 174 to lower latch mandrel 150. Outwardly disposed at the mandrel extension 172 is dog support 174. Dog support 174 includes a profiled uphole section 176 having uphole and downhole facing angled surfaces 178, 180. Surfaces 178, 180 function to actuate locating dogs 182. Actuation of dogs 182 occurs when profile 176 is moved uphole or downhole of dog pivot point(s) 184. Dogs 182 themselves include an uphole actuation surface 186 and a downhole retraction surface 188 whose interaction with profile 176 services to actuate the dogs and retract the dogs, respectively. A C-ring 190 is disposed around dog support 174. The C-ring interacts with grooves 192 and 194 to maintain actuation and retraction positions of dog support 174 subsequent to sufficient actuation force to move the support to the desired position by collapsing the C-ring over rib 196. A snap ring 195 is also set around mandrel extension 172 to move dog support 174 upon downward movement of other components, whose movement will be clear from the operation discussion hereunder. Grooves 192 and 194 are provided in a dog housing 197. Dog housing 197 is connected to cap 198 by thread 200. Cap 198 is further connected by thread 202 and set screw(s) 204 to lower shaft extension 170. Further, cap 198 includes an o-ring 206.

Operation

The communication and lock open tool has been described from an uphole end to a downhole end and with light reference to the interplay of components. In this section applicant will describe the complete operation of the device with reference to all of the figures of the application. It will be appreciated that this device is to be run in the hole to a TRSV 10 having the features described herein as unique over prior art TRSVs. Referring to FIGS. 2A-G, the tool is in a run-in position, no actuation having been started. Referring to FIGS. 3A-G actuation has begun in that the collet profile 72 has naturally snapped outwardly into lock profile 74 with a TRSV 10. In the illustrated embodiment the selective collet 81 has not been employed and is thus shown as of run-in engaged at attachment 85 with recess 91. It is noted that due to the reverse cut of shoulder 78 on the collet profile 72 and shoulder 76 of the lock profile 74 of TRSV 10 the tool in this position can and does hold some weight. The weight that is held by the reverse cut is sufficient to allow angle 50 of upper shaft 38 to bear against dogs 54 causing the dogs 54 and the upper latch mandrel 56 to move downhole. Such movement of course will cause shear screw(s) 60 to shear under that load. The load provided to shear shear screw(s) 60 is only present until dogs 54 move radially outwardly into recess 70 of upper latch extension 64. Upon dogs 54 moving into recess 70, angle 50 no longer bears upon dogs 54 and therefore the load is removed. At this point, the dogs 54 and upper latch mandrel 56 simply sit in the position illustrated in FIG. 3D until further actuated as described hereunder. Upper shaft 38 and components thereabove, and indeed components therebelow, which are discussed hereunder, continue to move downhole. It will be noted that latch support 80 will move under collet profile 72 at the same time that dogs 54 snap into recess 70. Once the latch support 80 is properly positioned under collet profile 72 the communication and lockout device is indeed locked into the TRSV 10 and will not move from that position until collet profile 72 is unsupported by latch support 80.

Simultaneously, with the support of collet profile 72, shaft 42 continues to move downhole causing slide 140 to move downhole with spring pin 142, lower shaft 156, lower shaft extension 170, cap 198, dog housing 197 and dogs 182. It will be noted that mandrel extension 172 does not move downhole and that because of snap ring 125 at a downhole end of mandrel extension 172, dog support 174 cannot move downhole with dog housing 197. Because dog support 174 cannot move downhole, the profiled uphole section 176 of dog support 174 is urged into contact with actuation surface 186 of dogs 182 uphole of pivot 184 causing the dogs to move outwardly. The outward movement of the dogs has two functions, firstly to open flapper 16 fully so that it may move behind tab 18 in TRSV 10 when thread 12 is sheared and secondly to locate and hold weight on shoulder 185 of dogs 182 in communication with shoulder 183 of TRSV 10. Helping to maintain the dogs in the desired position is C-ring 190, which moves over rib 196 into recess 194 from its original retraction position of recess 192.

With the locating dogs 182 in the located position, components 156, 170, 198, 197 and 182 can no longer move downhole. Thus, further movement of slide 140 in a downhole direction causes shearing of shear screw(s) 158 that previously connected slide 140 to lower shaft 156 and allowing slide areas 145 to slide past spring pin 142 until downhole end 144 of slide 140 contacts lower latch mandrel 150. Downward movement of lower latch mandrel 150 causes lower latch collet 162 to move outwardly on surfaces 160 and 164 thereby increasing its diametral dimension until surface 163 engages shifting profile 165 within TRSV 10. Simultaneously, lower latch mandrel 150 through cap screws 174 causes mandrel extension 172 as well as lower latch collet 162 to move further downhole. Upon this movement and referring to FIGS. 3F and 4F directly, the thread 12 is sheared causing flapper 16 to move behind tab 18 to lock open the flapper 16. As noted above, mandrel extension 172 is also moving downhole simultaneously. That downhole movement without other effect is limited by shoulder 173 which will contact shoulder 175 of dog support 174. Upon contact between shoulders 173 and 175, C-ring 190 is moved from recess 194 back into recess 192 causing profiled uphole section 176 of dog support 174 to interact with the retraction surface 188 of dogs 182 thereby causing dogs 182 to disengage from TRSV shoulder 183 and retract to their pre-actuation position. At the same time that dogs 182 retract, the lower latch collet 162 reaches a downhole facing surface 167 of lower shaft 156 which allows lower latch collet 162 to snap back into its pre-actuation dimension but in a different position downhole of surface 167. This movement disengages the lower end of the tool from the TRSV and concludes the lock open operation. The fact that the lock open operation has been concluded is signaled to an operator by a drop of the tool approximately eight inches once dogs 182 and collet 162 are disengaged from TRSV 10. The positions of the components of the tool following the approximately eight-inch drop are illustrated in FIGS. 4A-4G.

Figure 9D:
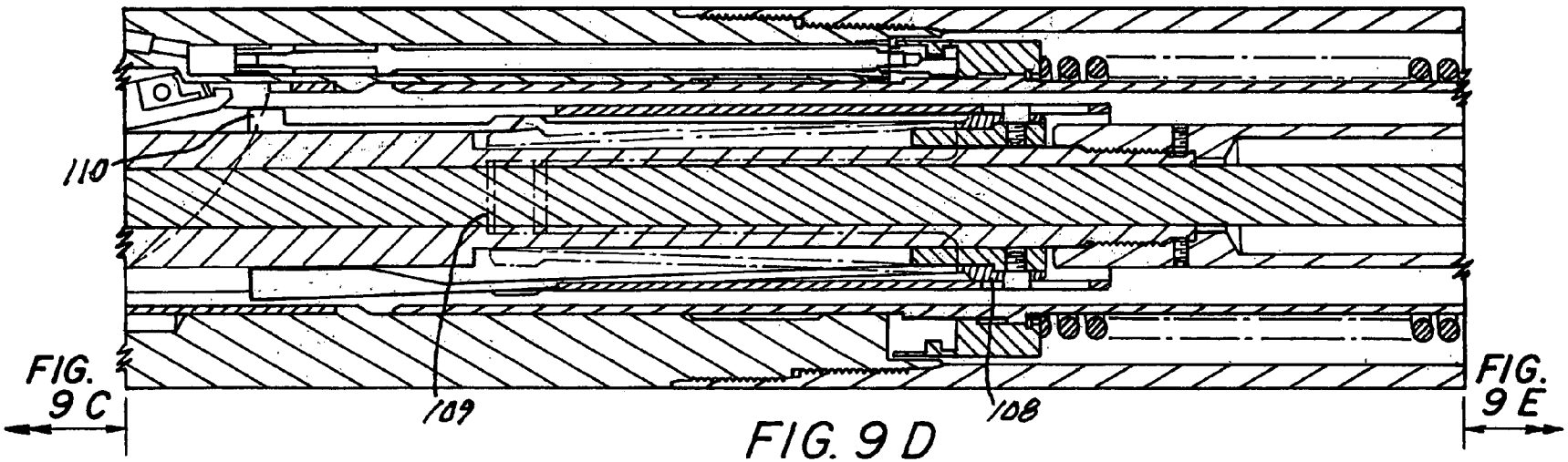
Figure 8E:
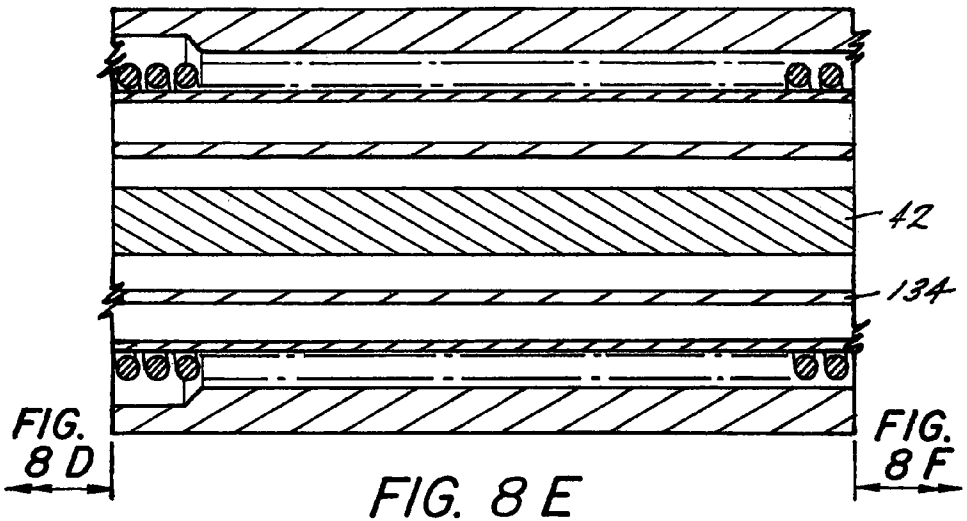
Figure 9E:
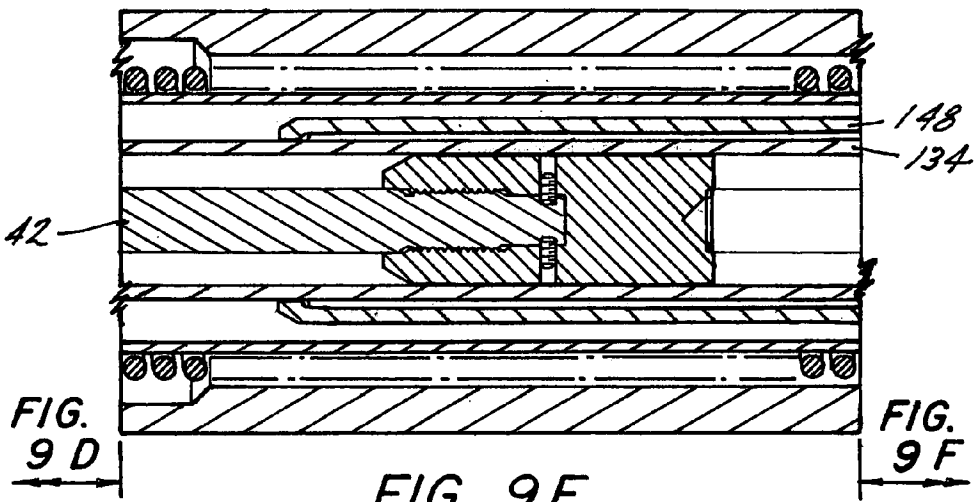
Figure 8F:
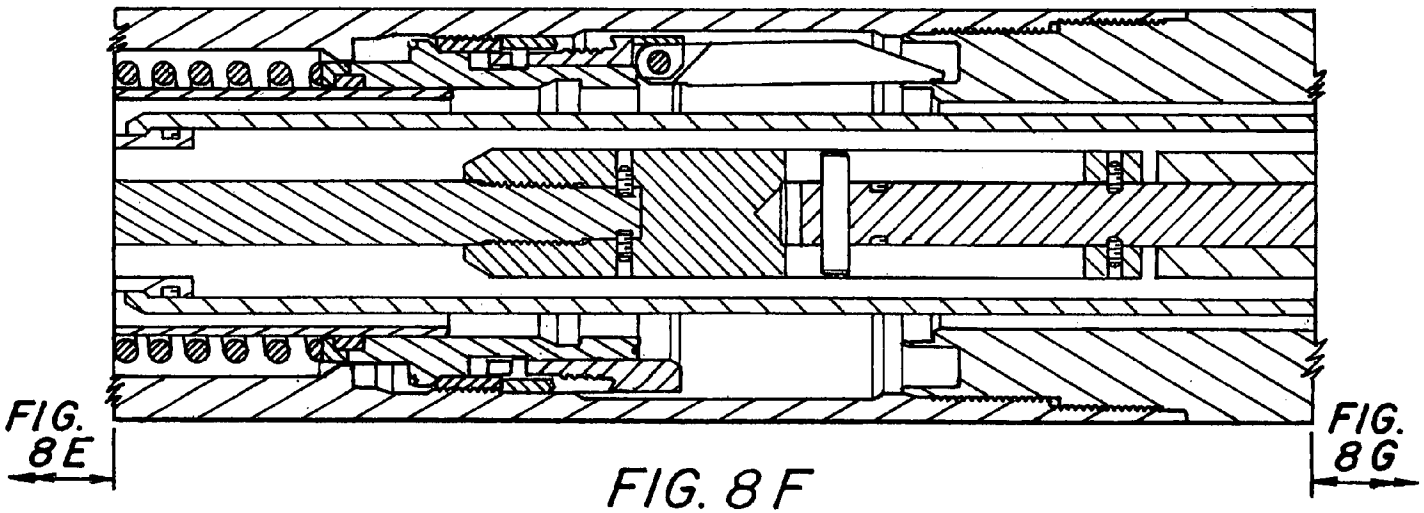
Figure 9F:
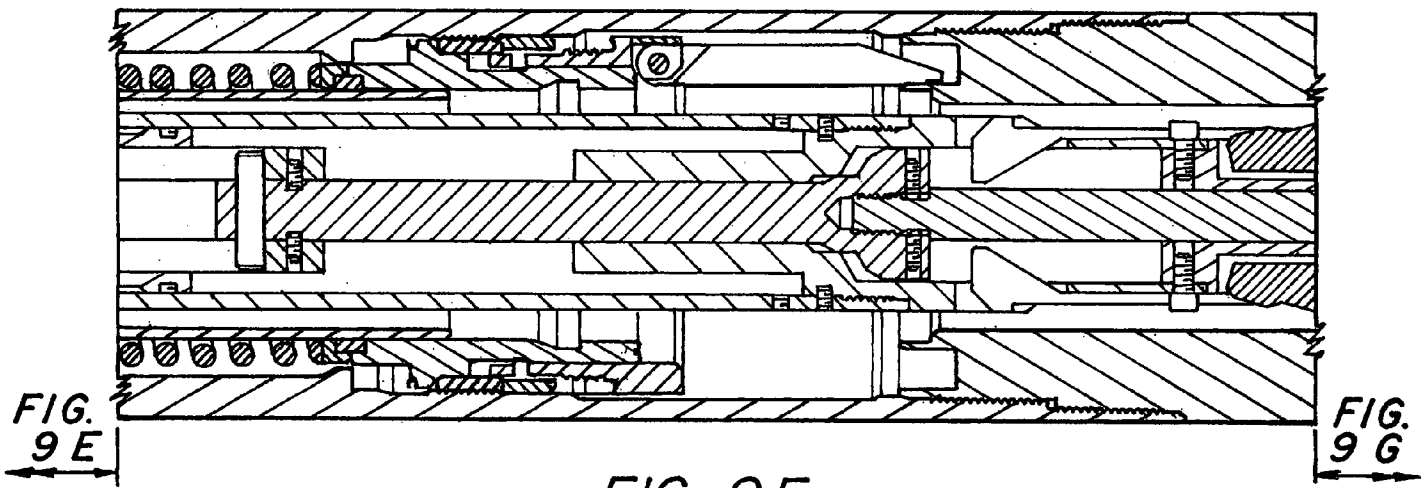
Figure 8G:
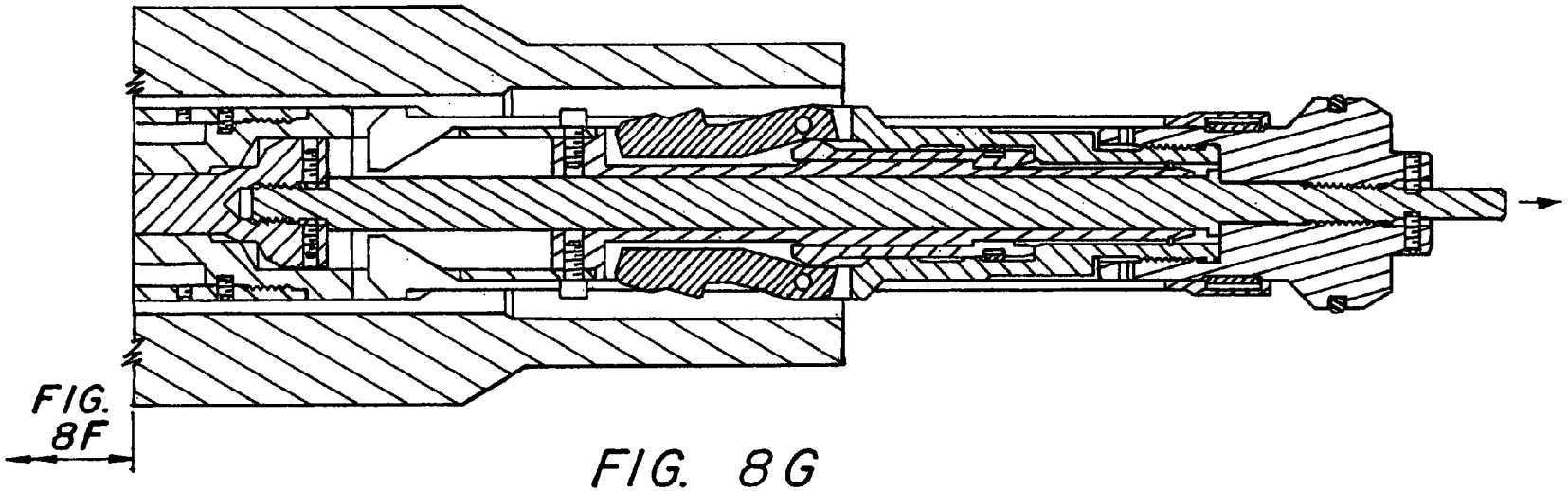
Figure 9G:
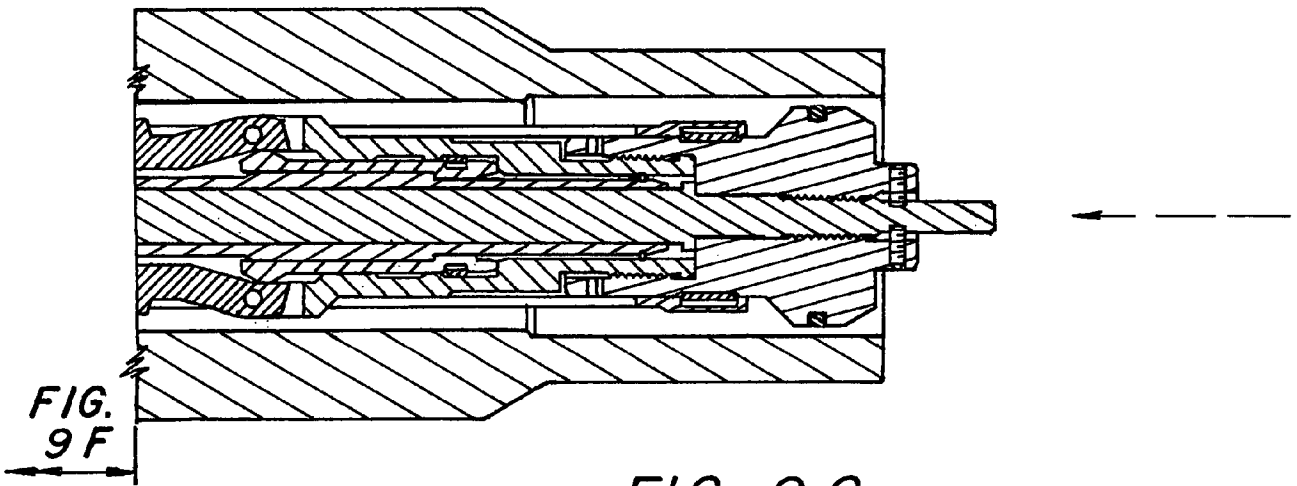
Figure 10A:
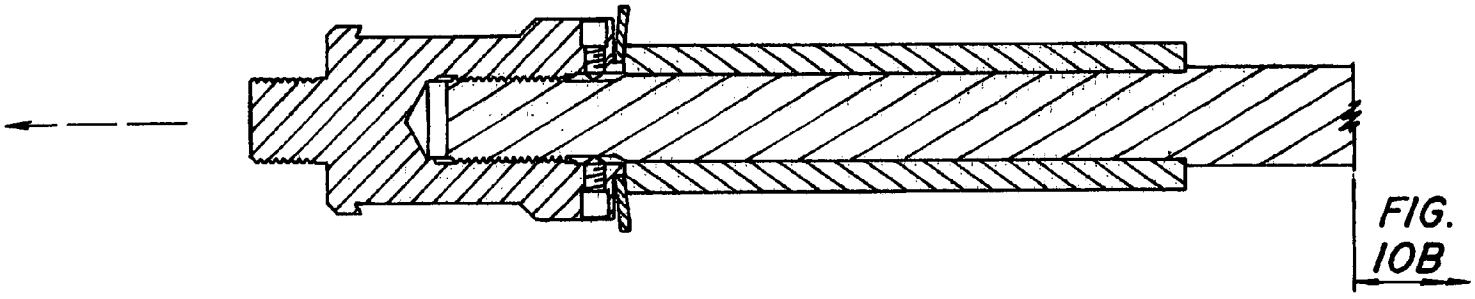
Figure 11A:
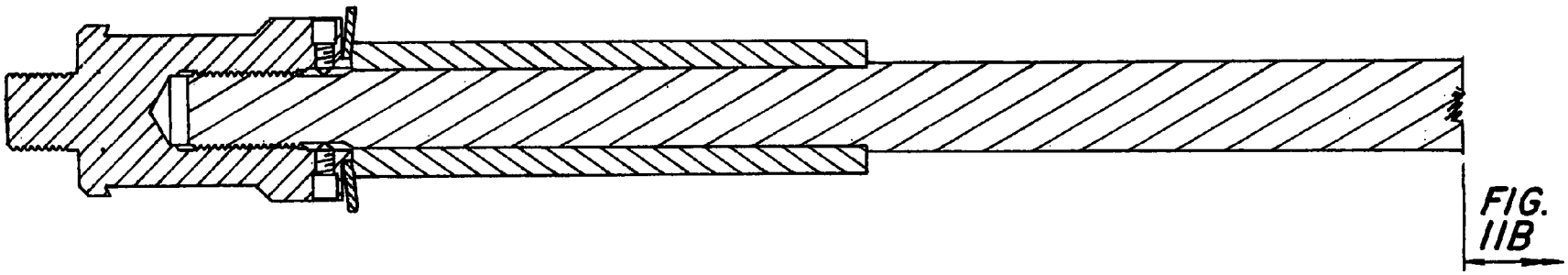
Figure 10B:
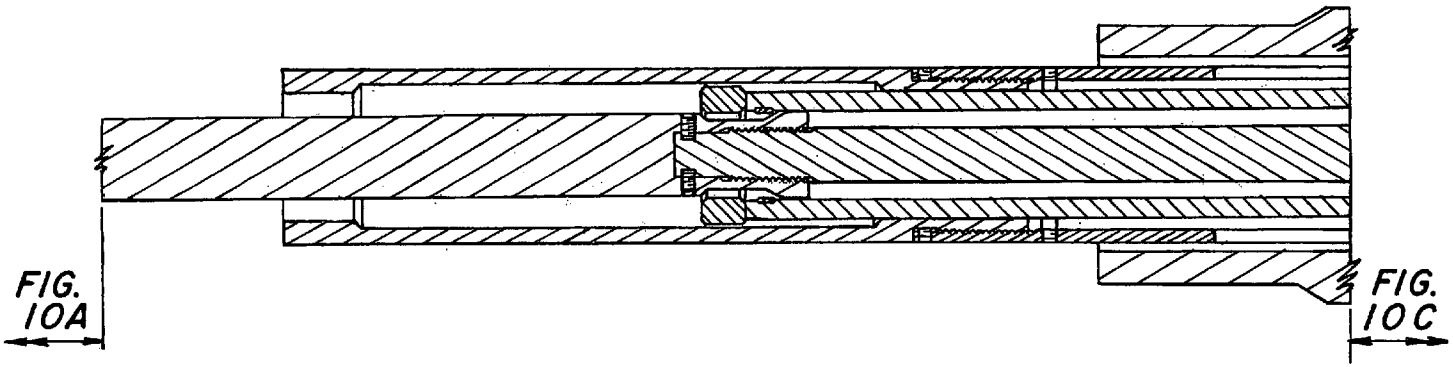
Figure 11B:
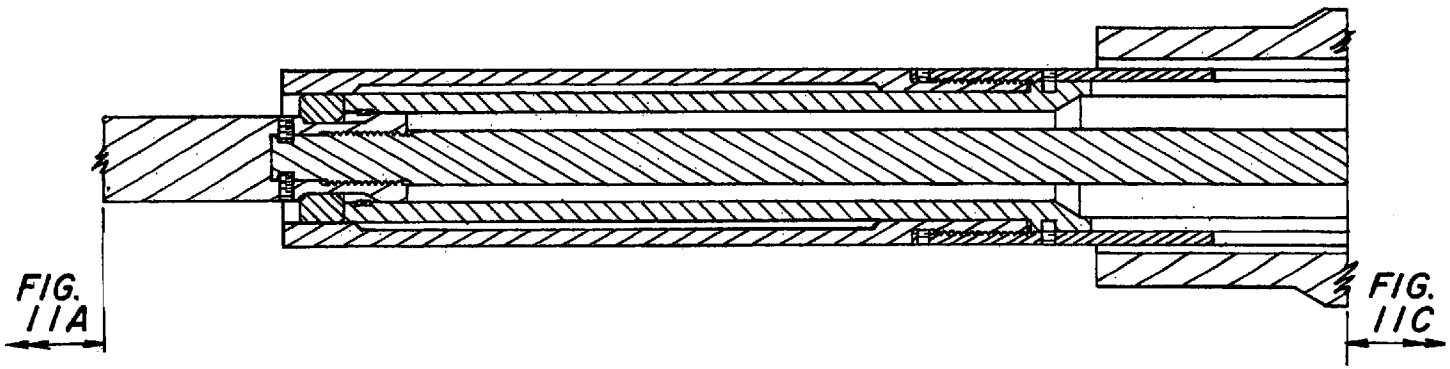
Figure 10C:
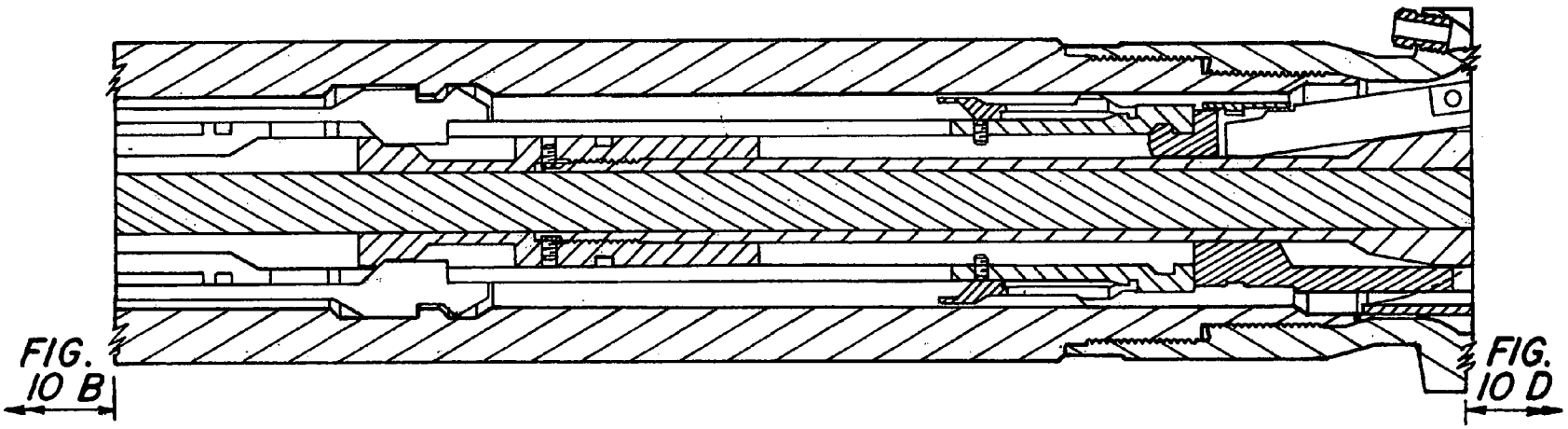
Figure 11C:
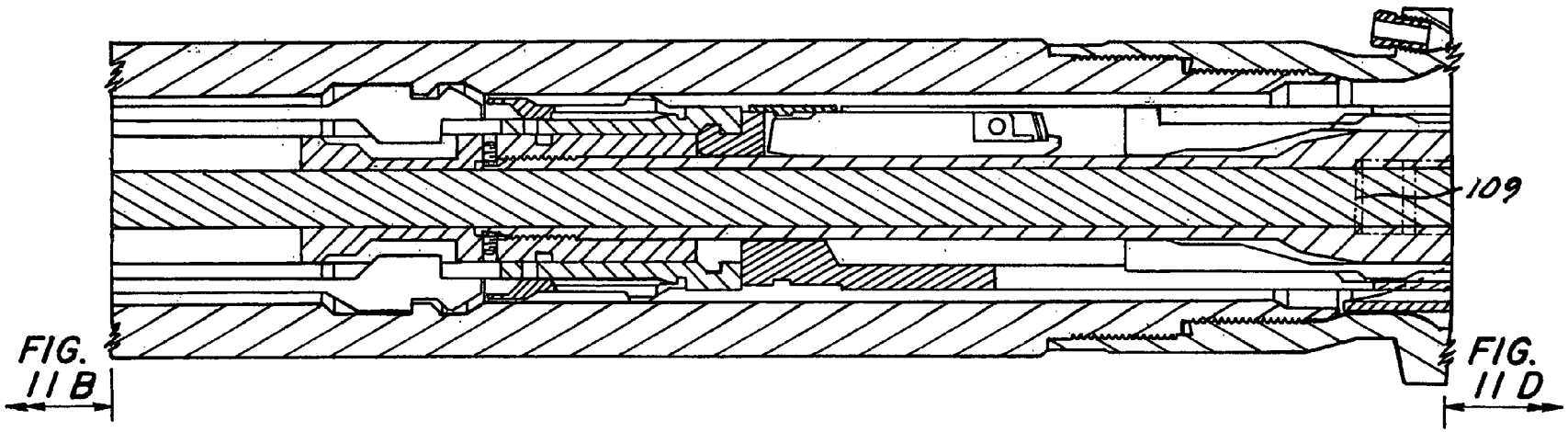
Figure 10D:
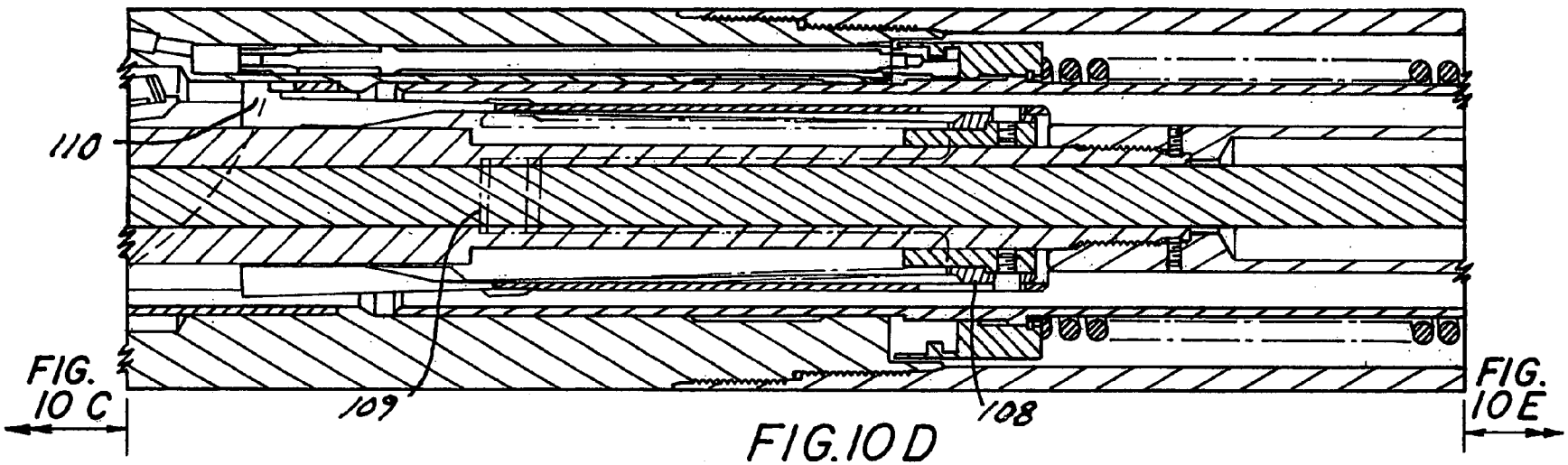
Figure 11D:
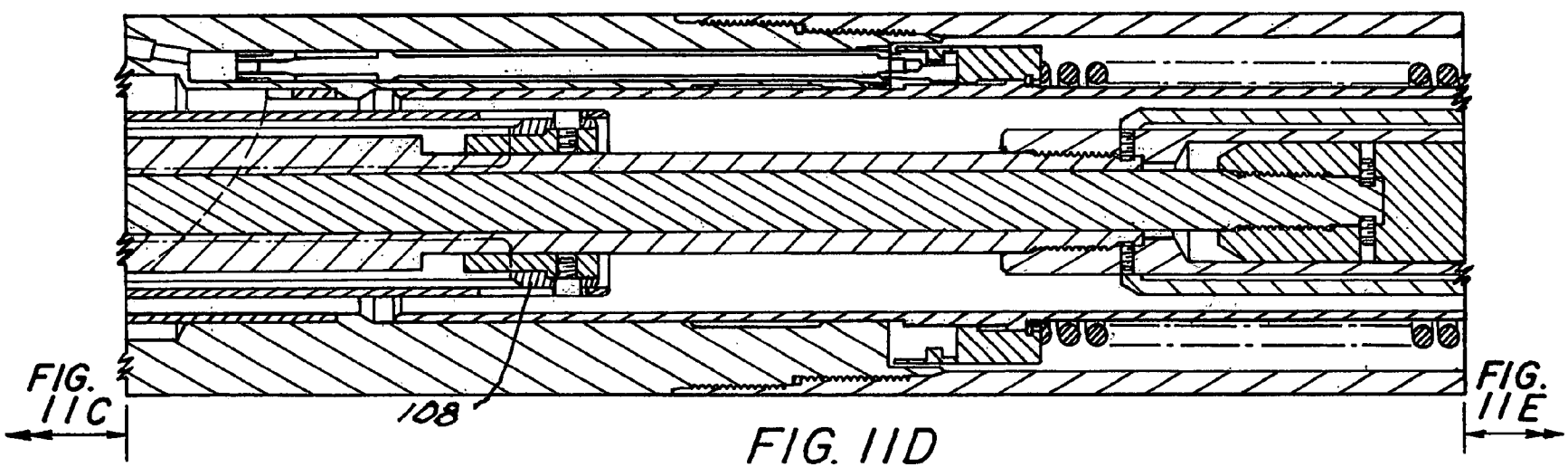
Figure 10E:
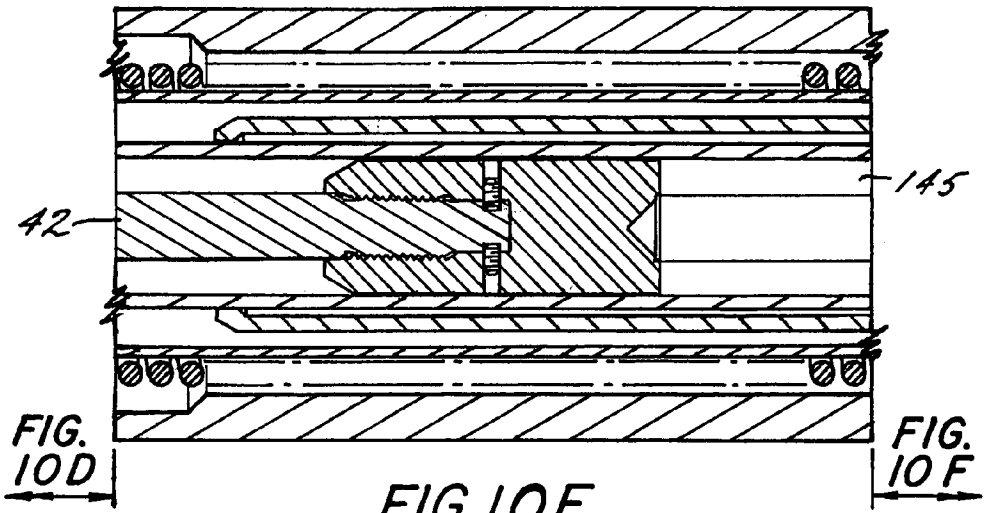
Figure 11E:
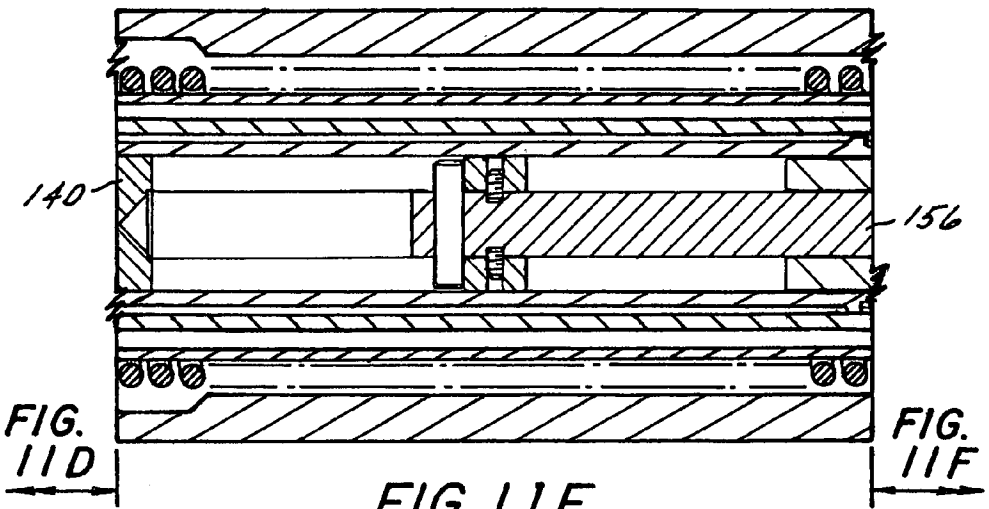
Figure 10F:
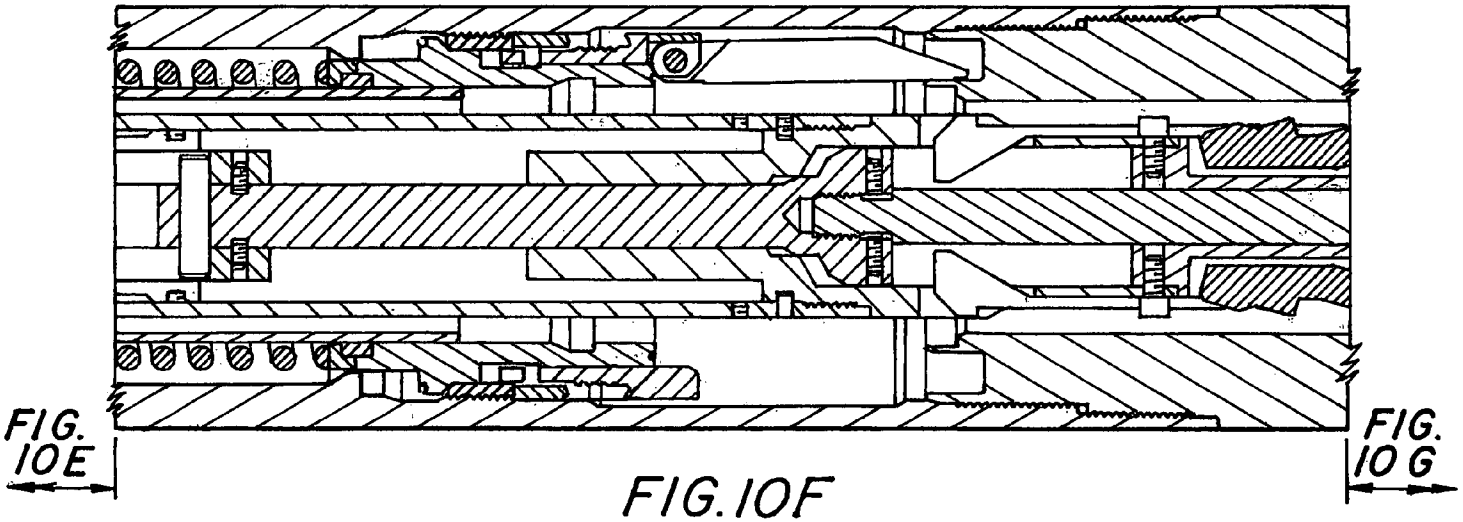
Figure 11F:
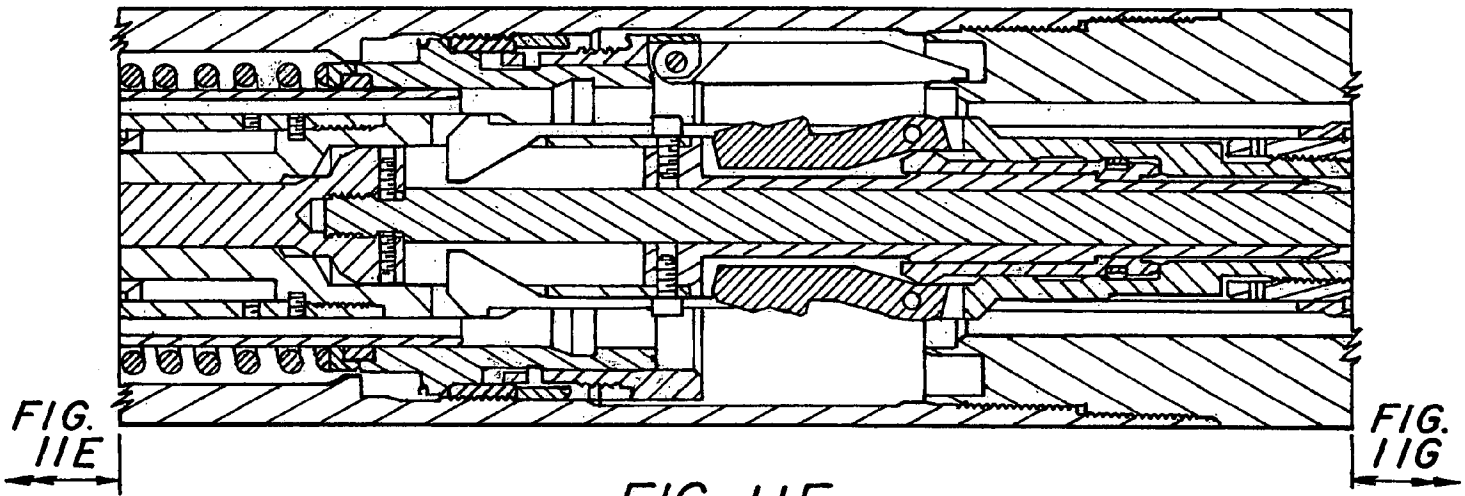
Figure 10G:
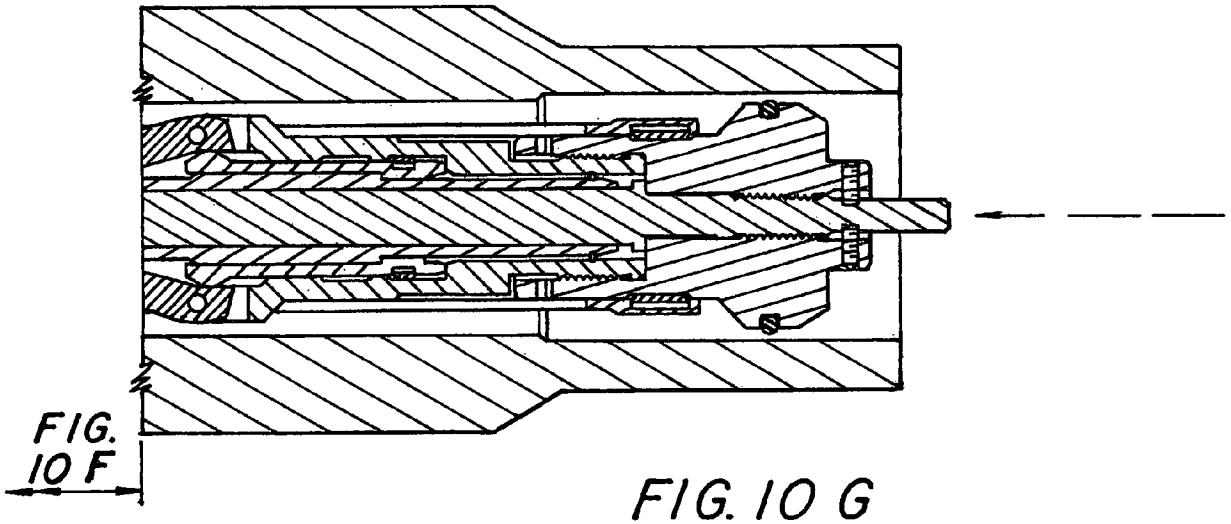
Figure 11G:
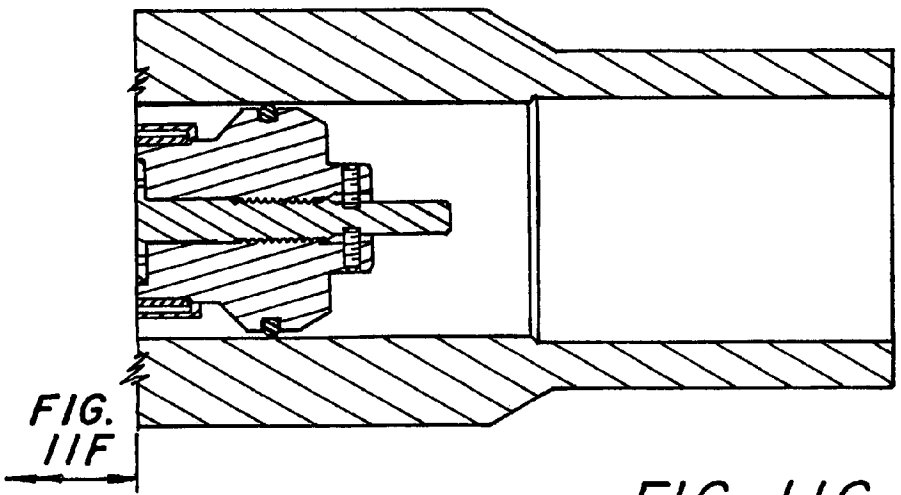

With the lock out operation concluded, it is time to create communication with the old piston bore 20 such that a new wireline retrievable safety valve can be installed and operated from the original control line 22. With the tool in the position indicated in FIGS. 4A and 4B, one will note that upper shaft sleeve 34 has come into contact with dogs 54 thereby reloading those dogs which were unloaded at the beginning of the lock open operation by moving into recess 70. Referring to FIG. 6, with the further downhole movement of uphole components 32, 36, 34, 38, one will appreciate that dogs 54 have been urged downhole thereby urging upper latch mandrel 56 downhole as well. This movement loads shear screw(s) 86 and shears them at a selected load causing guide 94 to begin moving downhole, which itself urges alignment collet 108 downhole. It should be noted at this point that the urging of alignment collet 108 downhole does not occur from the uphole edge of alignment collet 108 at alignment tab 110 but rather occurs at short collet ends 109 which are visible in broken lines to show location in each of the drawings but are also shown deflected in broken lines in FIGS. 8D, 9D and 10D to illustrate how they function relative to mandrel 112. It is apparent herefrom that the short collet fingers are urged inwardly through the combined action of angle 95 and mandrel neck down 113.

Figure 12:
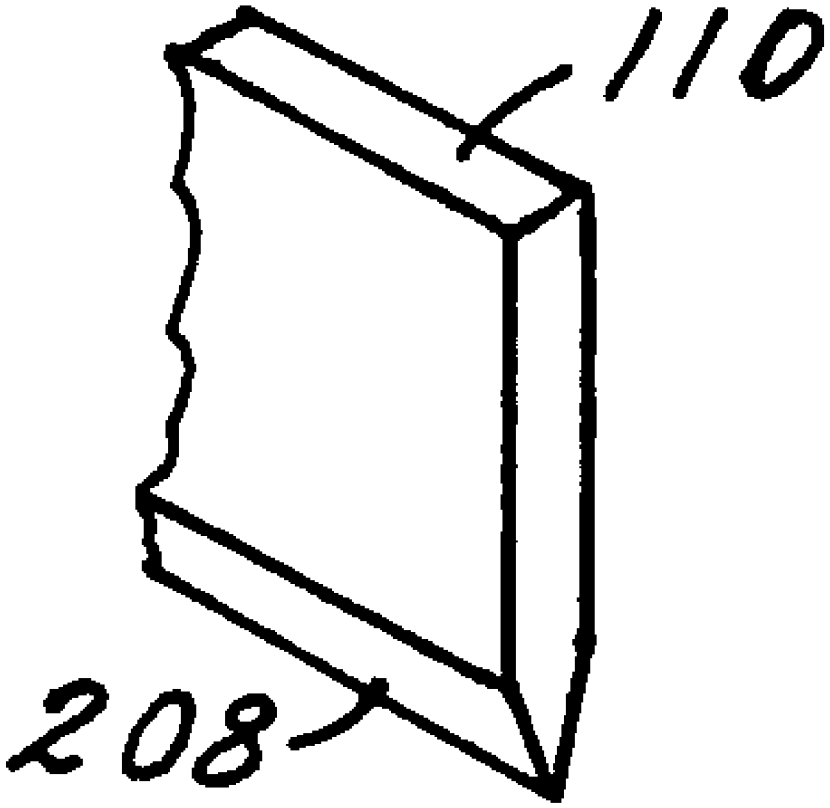
FIG. 12 is an enlarged view of tab 110 to illustrate the chisel edge.

As the alignment collet 108 moves downhole it will move outwardly in a recess area 111 of the original TRSV 10 such that alignment tab 110 will land on alignment profile 14. In order to make the drawings most clearly illustrate the movement of the device, the alignment tab has been originally illustrated in a position 180 degrees off from its final desired aligned position. It will be understood that the alignment profile 14 occurs around the perimeter of the TRSV, such as a mule shoe, so that regardless of the orientation of the communication and lock open device upon initial run-in the alignment tab 110 will be picked up by some portion of the alignment profile 14 and will thereby be rotated into alignment to allow for the cutting device to create the communication desired. Also noted is that normally device 30 is not used until a sufficient time has passed from original well completion that it is likely scale has built up on surfaces downhole. Because of this likely condition, it is desirable to provide a chisel-like cutting edge on tool tab 110 to cut through the scale allowing the tab to follow profile 14 as intended. A schematic view of the chisel-like cutting feature is illustrated as numeral 208 in FIG. 12.

Figure 7A:
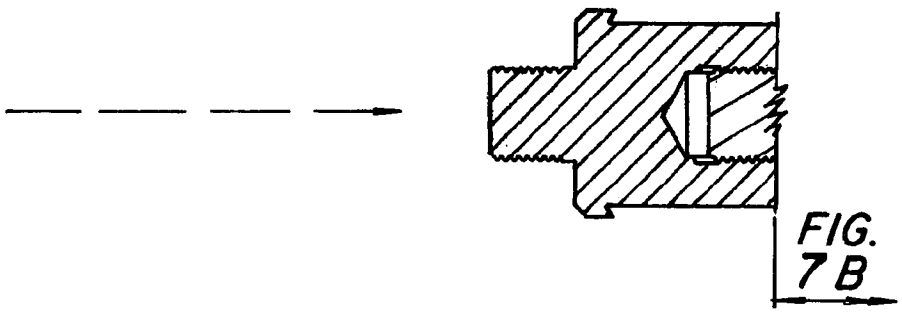
Figure 7B:
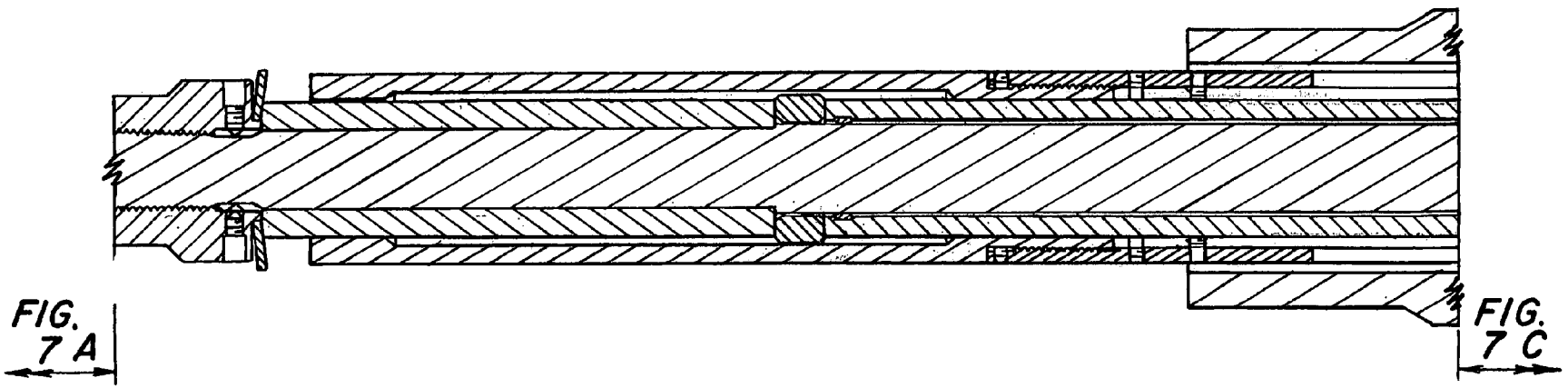
Figure 7C:
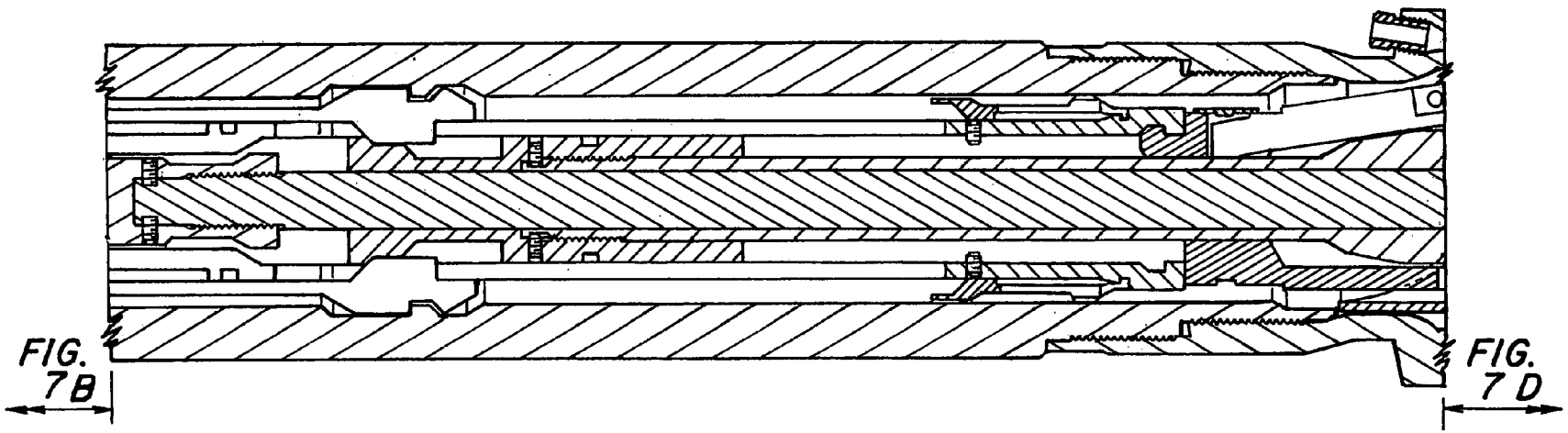
Figure 6D:
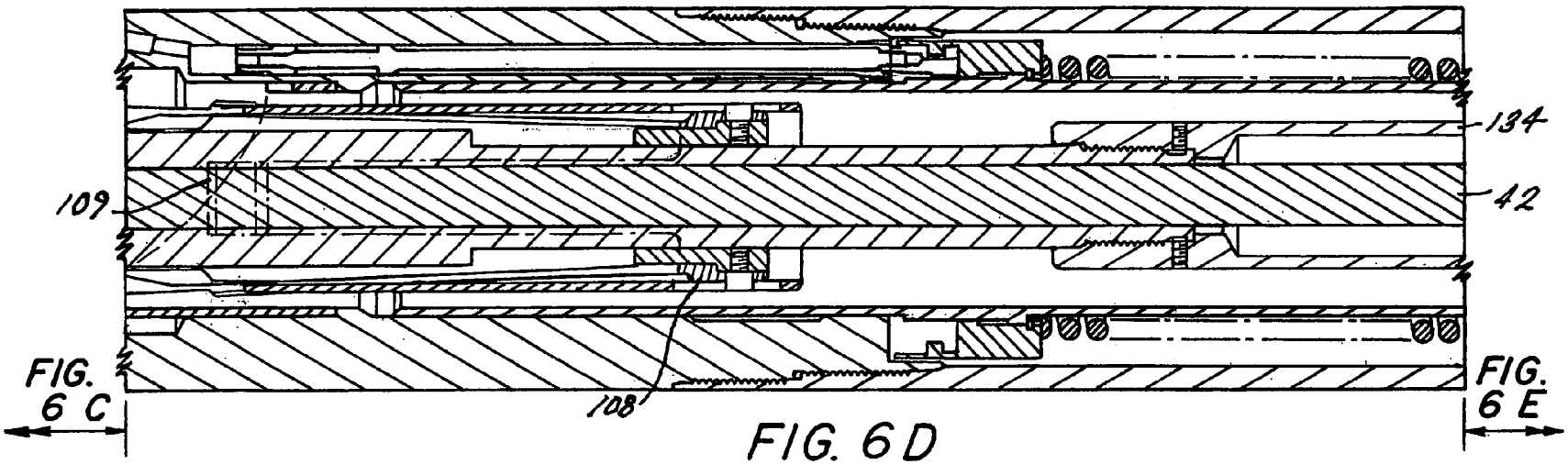
Figure 7D:
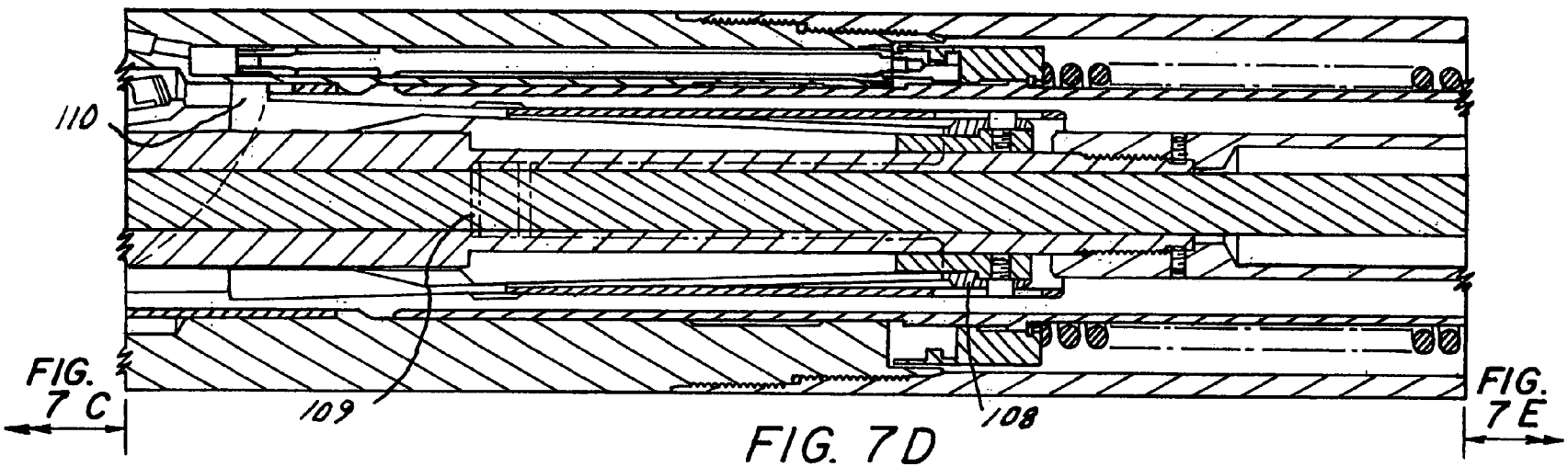
Figure 6E:
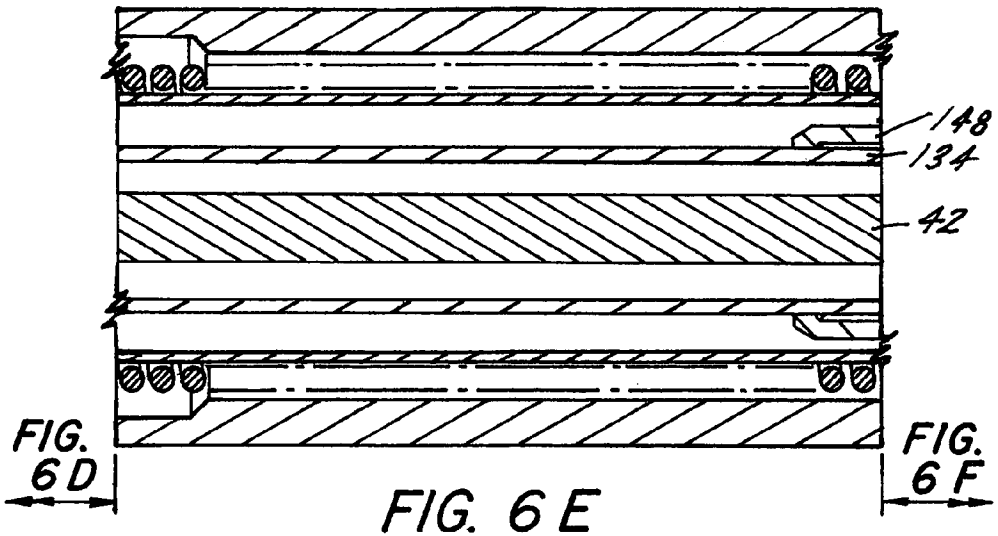
Figure 7E:
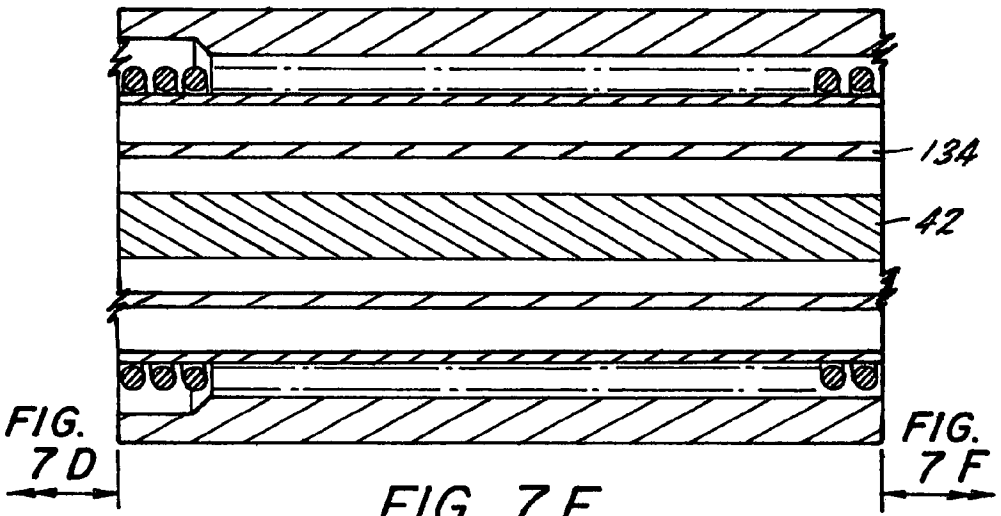
Figure 6F:
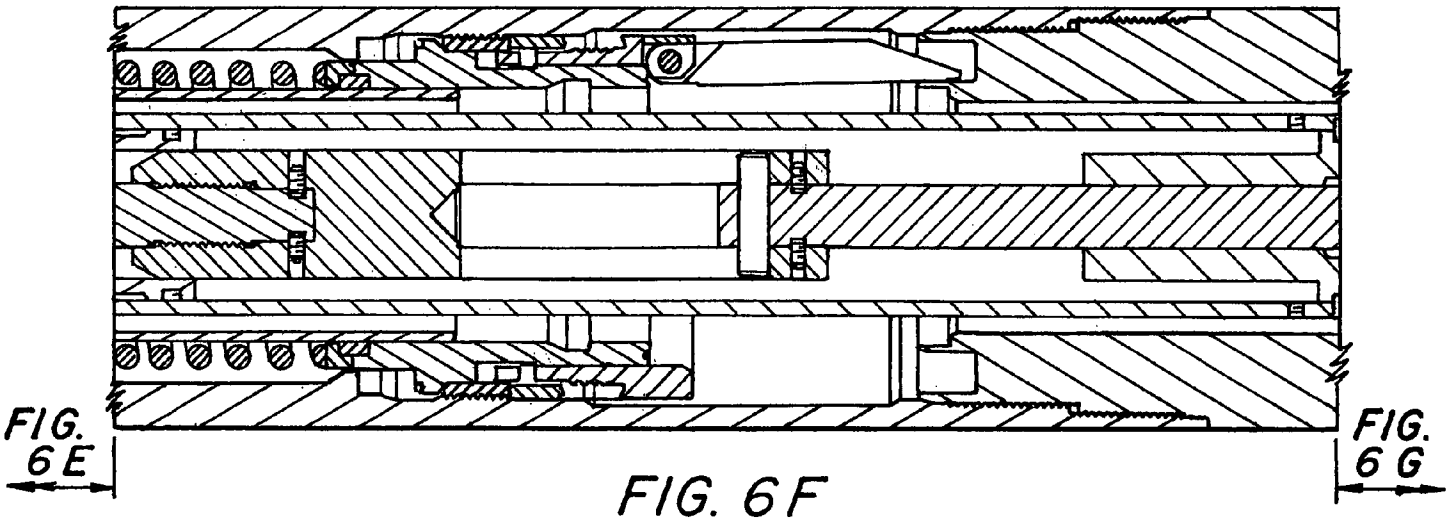
Figure 7F:
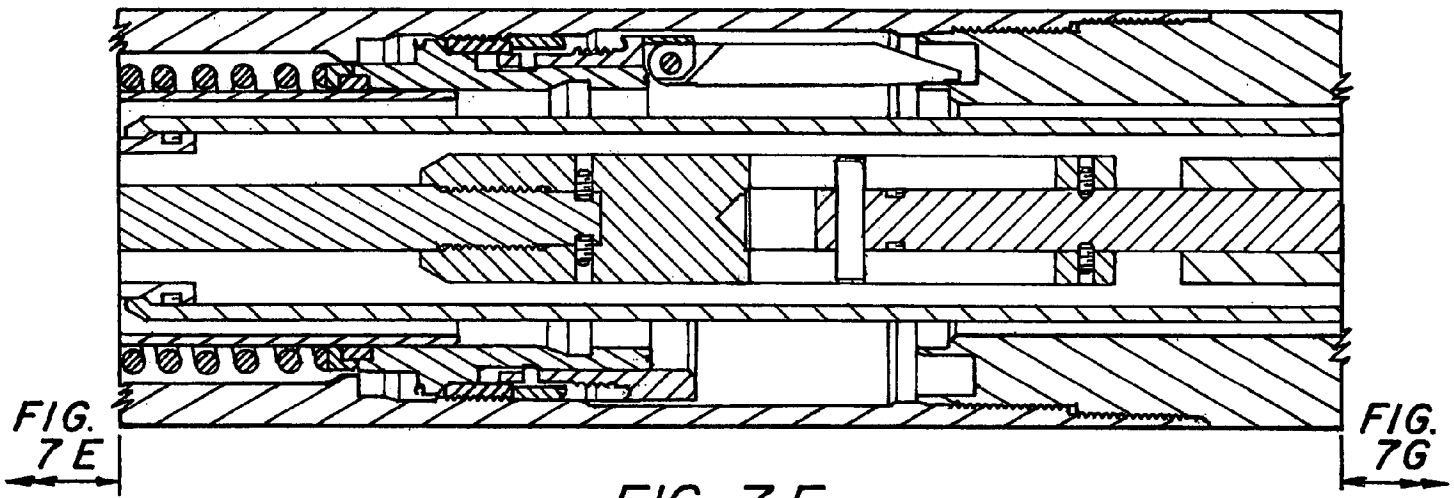
Figure 6G:
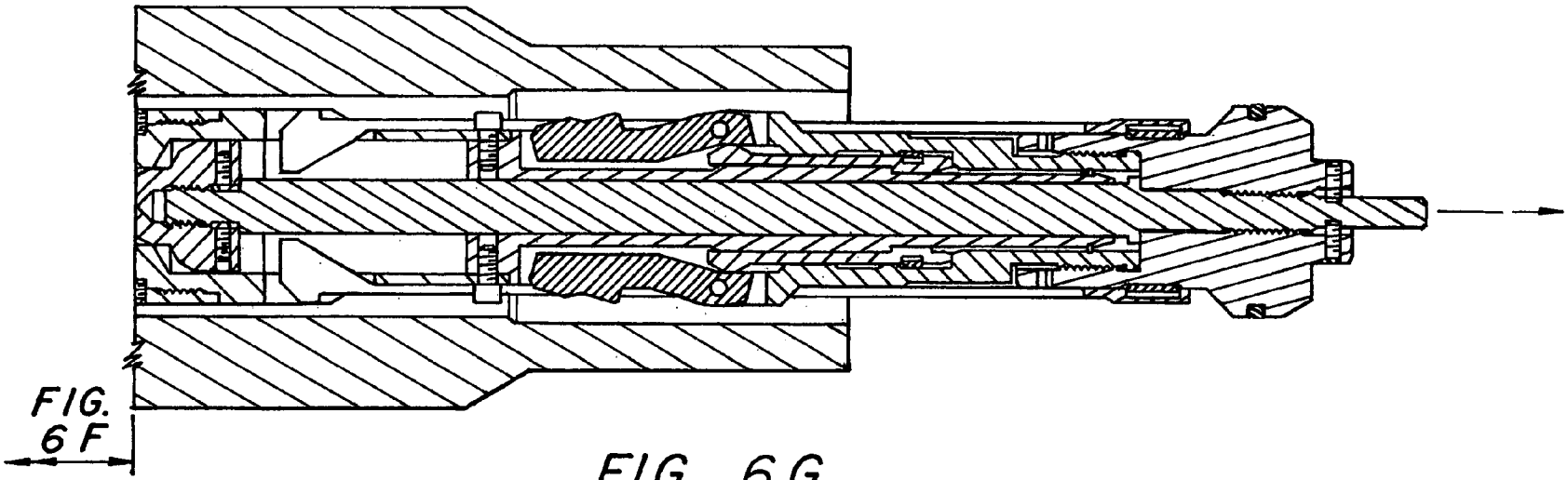
Figure 7G:
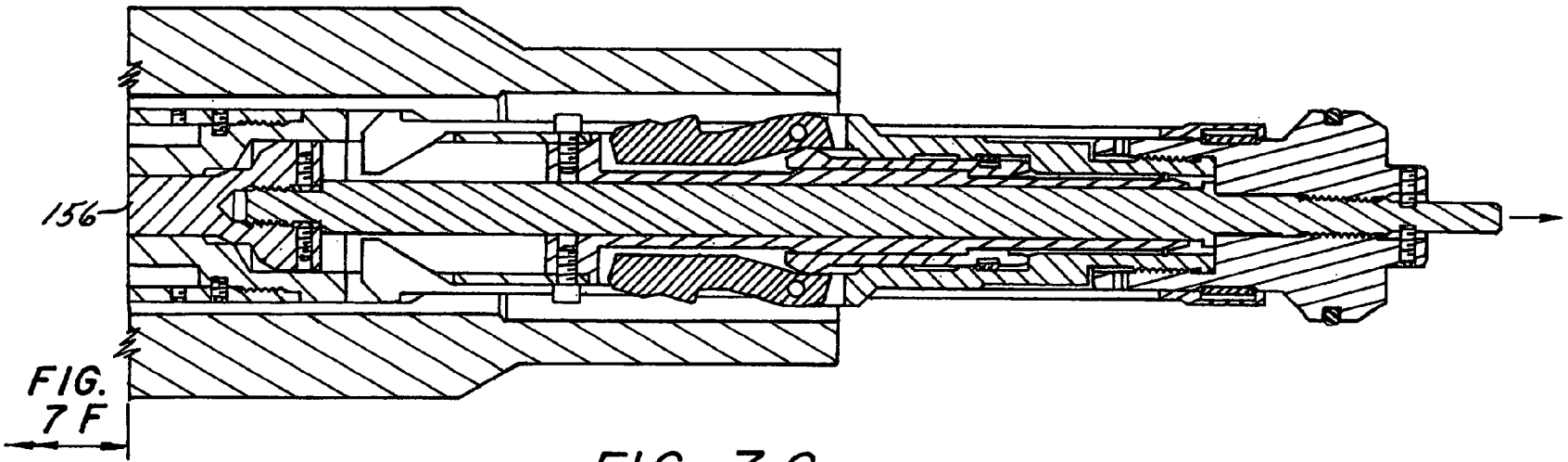
Figure 8A:
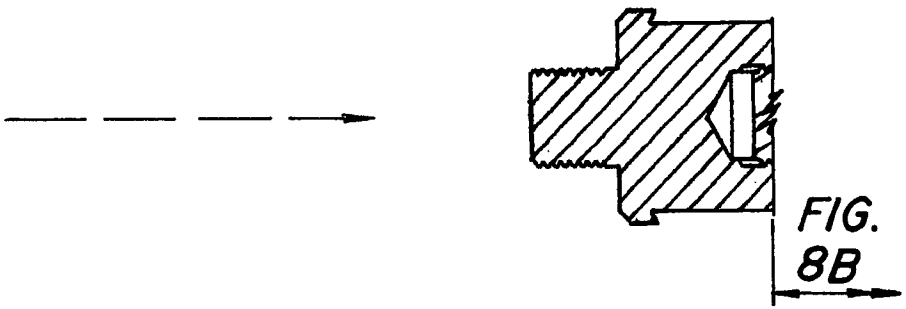
Figure 9A:
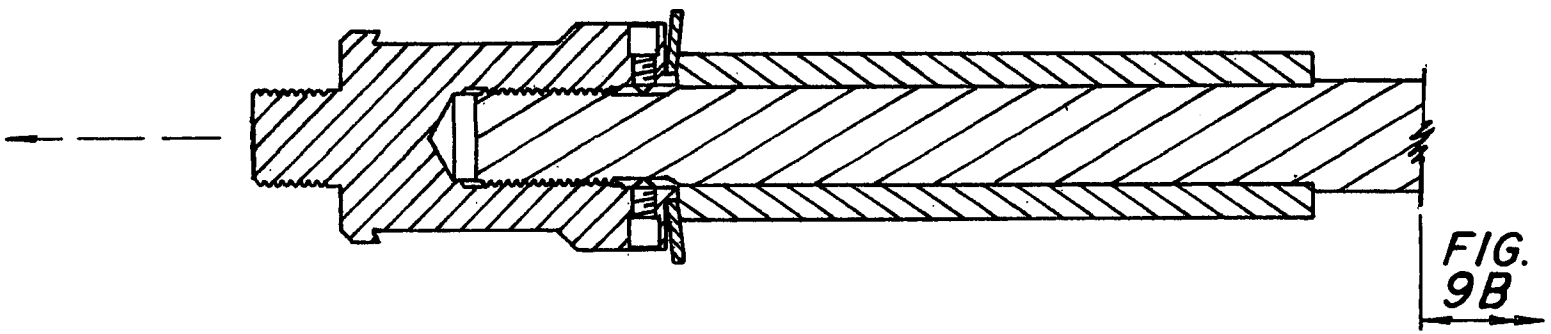
Figure 8B:
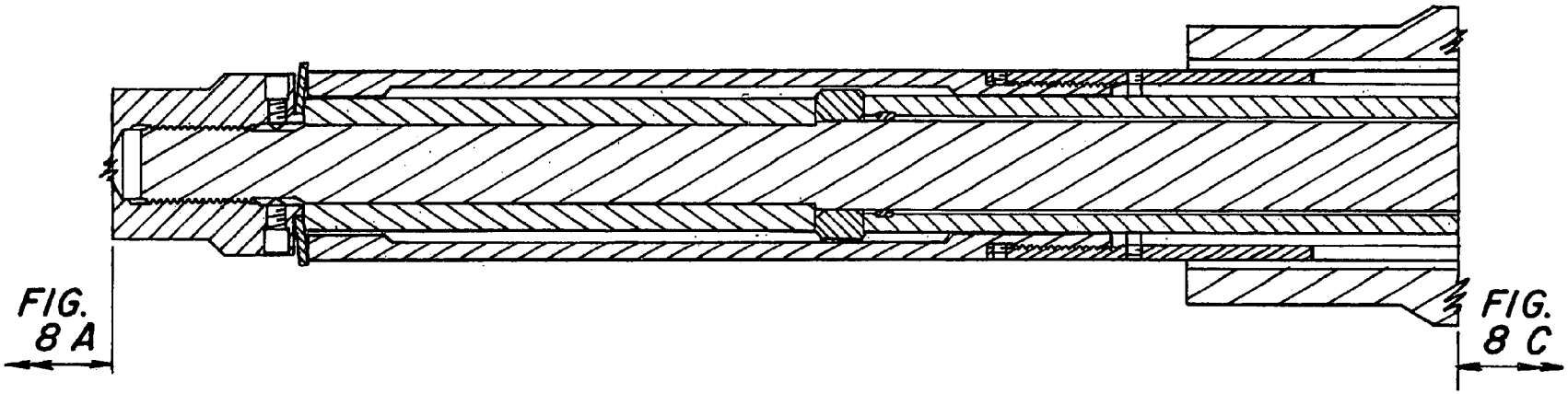
Figure 9B:
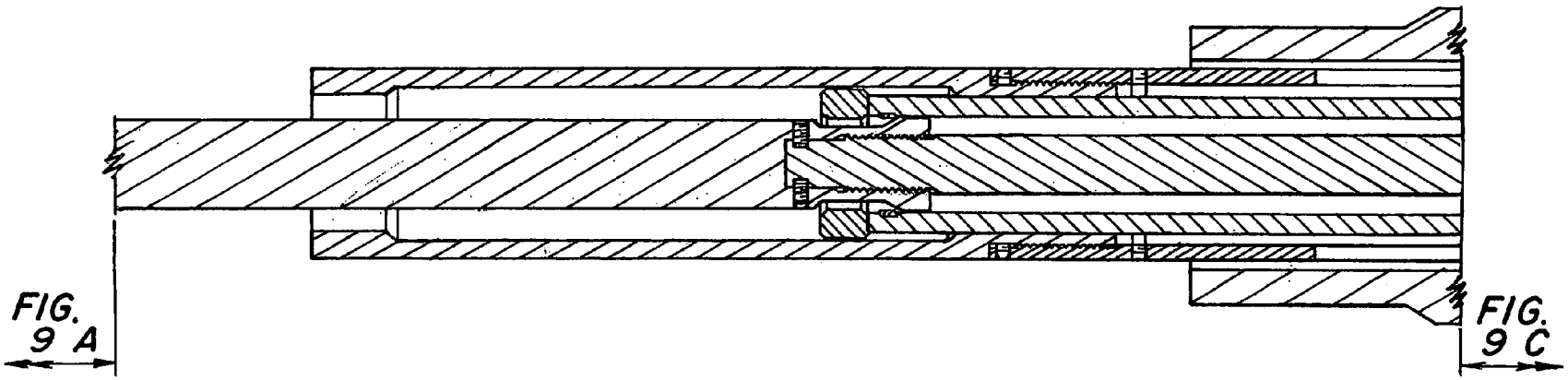
Figure 8C:
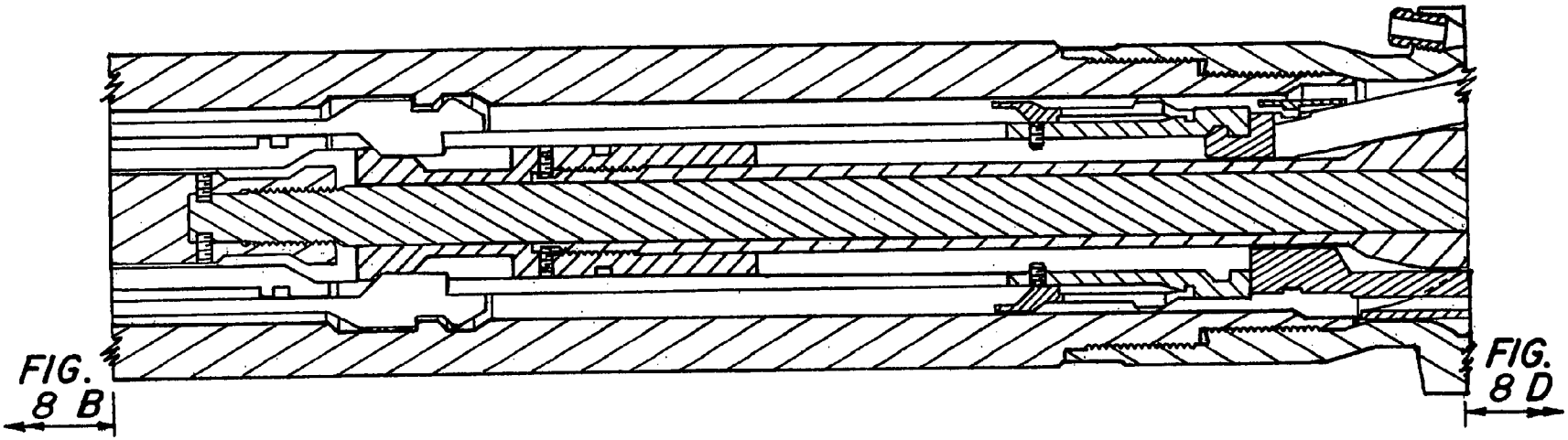
Figure 9C:
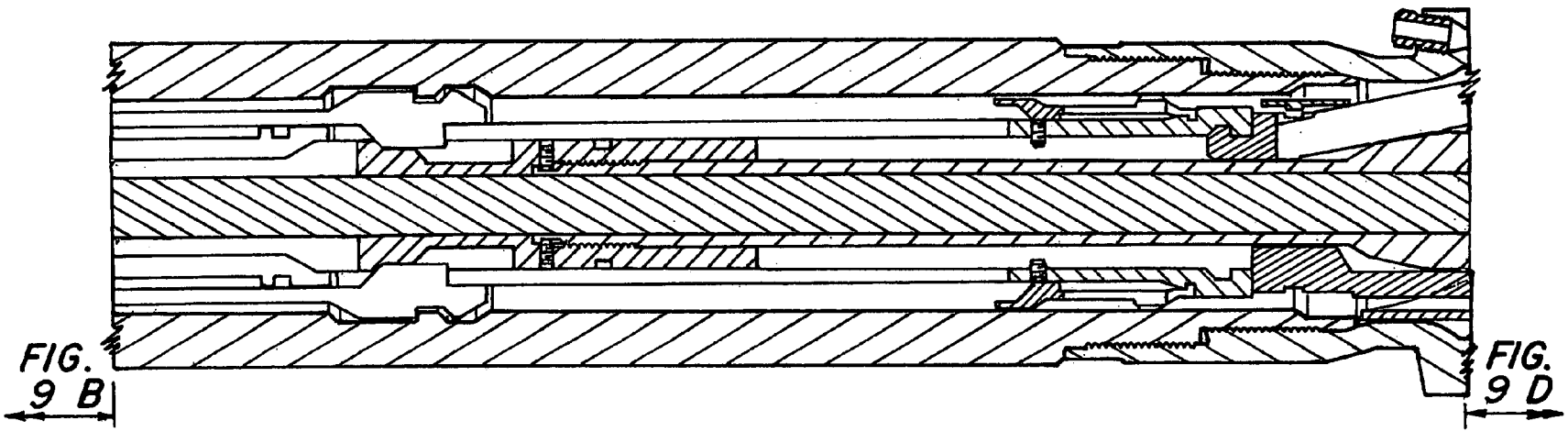
Figure 8D:
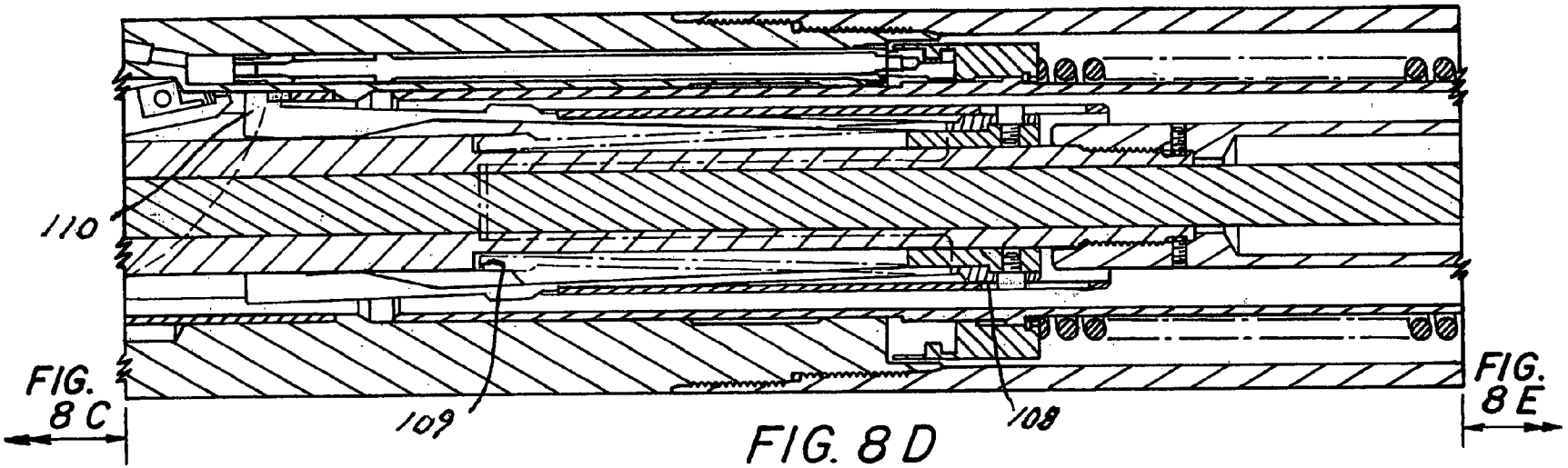

Referring to FIGS. 7C and 7D the device has now rotated the alignment collet 108 and thereby the guide 94 into the appropriate position. In the appropriate aligned position, cutter dog 98 and cutter 100 are positioned longitudinally uphole of the piston bore 20 of original TRSV 10. Further downhole movement of upper shaft 38 and related components causes the upper latch mandrel 56, the guide 94 and cutter dog 98 with cutter 100 to continue to move downhole into contact with mandrel 112 frustoconical sections 114 and 116 to position the cutter to open a communication channel with the piston bore 20. Once the cutter is positioned correctly the purpose of slot 127 becomes apparent. At this point in the procedure the alignment collet 108 has been rotated and dropped into its retaining slot in the TRSV 10 and can no longer move downhole, yet the cutter 100 is still uphole of the piston bore 20. Further downhole movement of upper latch mandrel 56 and related components as set forth hereinabove cause the cutter 100 to move longitudinally downhole onto frustocones 114 and 116 and into piston bore 20 of TRSV 10, cutting a path into piston bore 20 and thereby opening communication to the inside dimension of TRSV 10 from the original control line surface or other remote location. In order for the movement of guide 94 downhole to allow the cutter to enter piston bore 20 guide 94 must be able to move relative to alignment collet 108. Slots 127 allow for such movement. FIG. 8D illustrates the cutter inside the space of piston bore 20. At this point and referring to FIG. 9 the tool is to be withdrawn from the downhole environment thus making way for a later run WRSV or other replacement valve or tool. Upon the beginning of the uphole pull on fishing neck 32, upper shaft 38 moves upwardly within upper latch mandrel 56 until a bottom end angle 48 of upper shaft 38 picks up on ring 58 such that the upper shaft 38 can pull upper latch mandrel 70 uphole. Further, the cutter dog is unsupported from the frustocones 114, 116 and brought back into its original unactuated position by cutter retainer 96. This is illustrated in FIGS. 9, 10 and 11. As the fishing neck reaches full extension, the upper latch mandrel 56 moves back to its original position where its shoulder on upper latch extension 64 and guide 94 comes back into contact with latch support 80. Further pulling uphole unsupports collet profile 72 so that it is collapsible and therefore disengagable from TRSV 10 and the tool is withdrawn from the hole.

Further to the foregoing discussion of a first embodiment of the control system communication and lock open tool there are several components that can be replaced with alternatives. The alternative components may be individually substituted for those described above, may be substituted in groups or may all collectively be substituted for like components as described above.

Figure 2A:
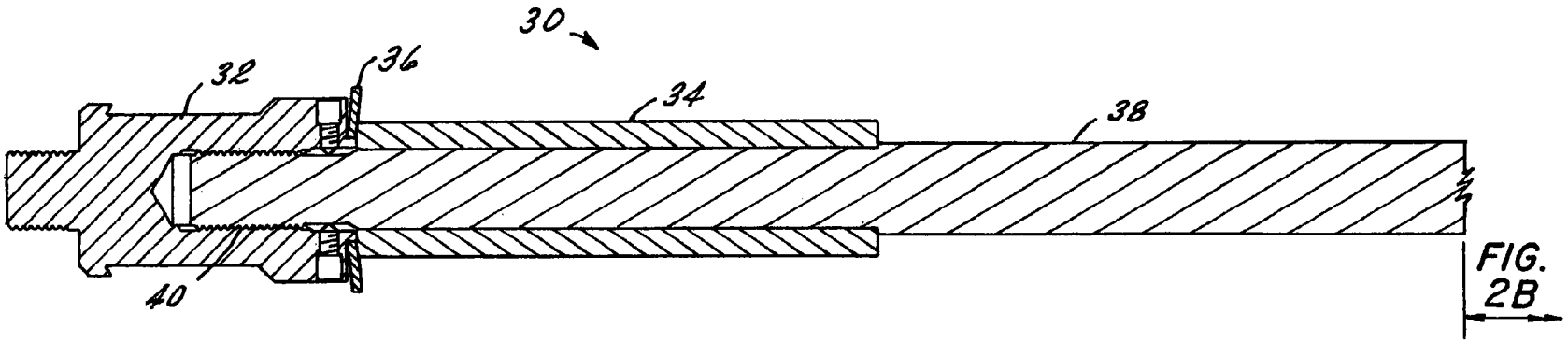
FIGS. 2A-G, 3A-G, 4A-G, 5A-G, 6A-G, 7A-G, 8A-G, 9A-G, 10A-G and 11A-G, are all extended view of one embodiment of the communication and lockout device in progressive actuation positions.
Figure 2B:
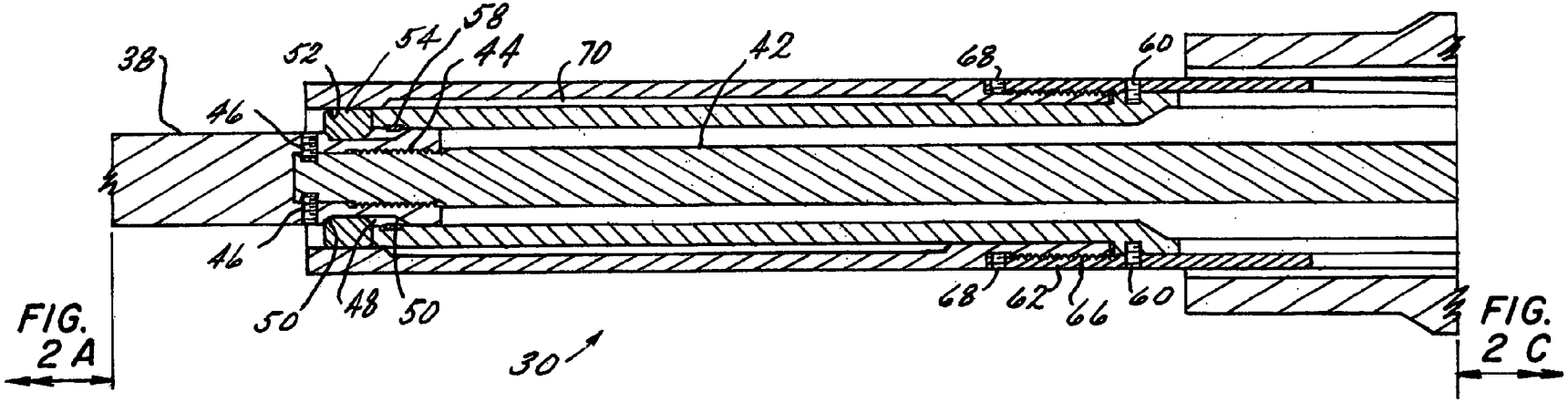
Figure 2C:
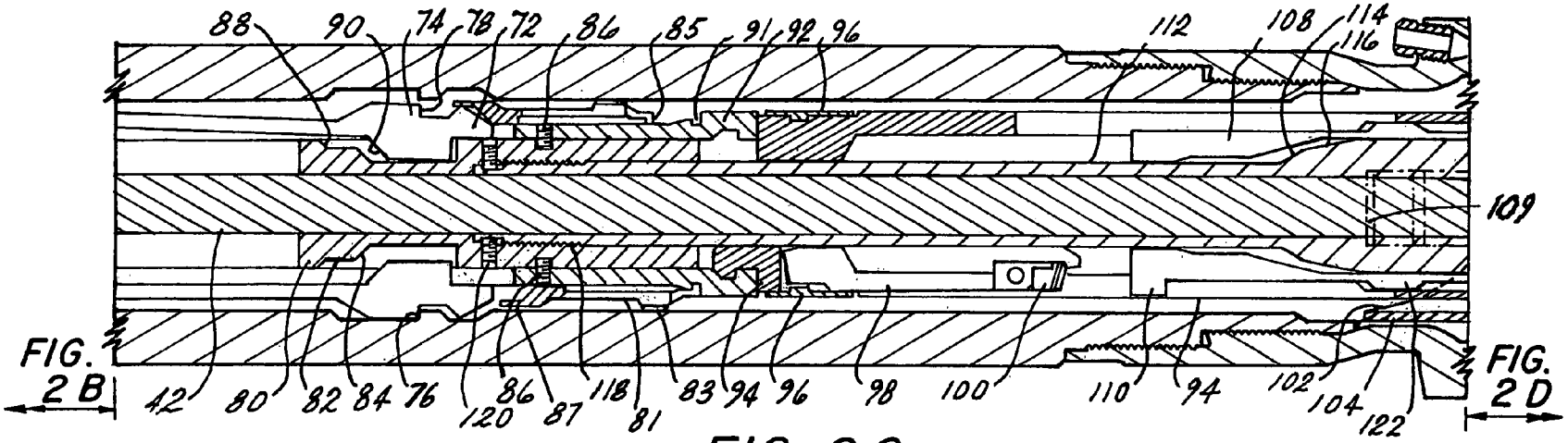
Figure 3C:
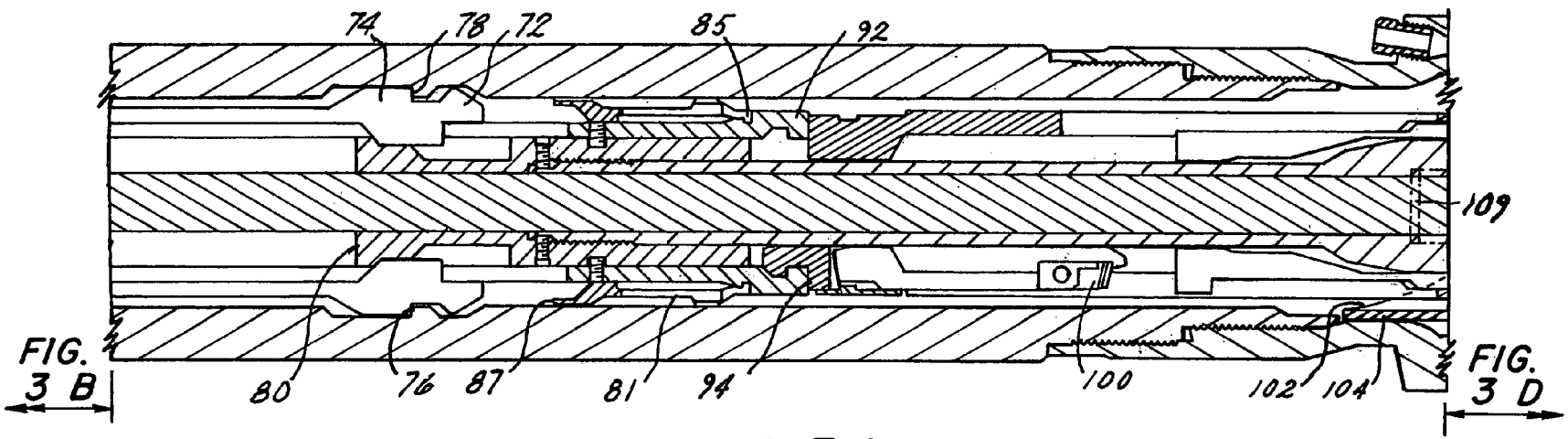
Figure 2D:
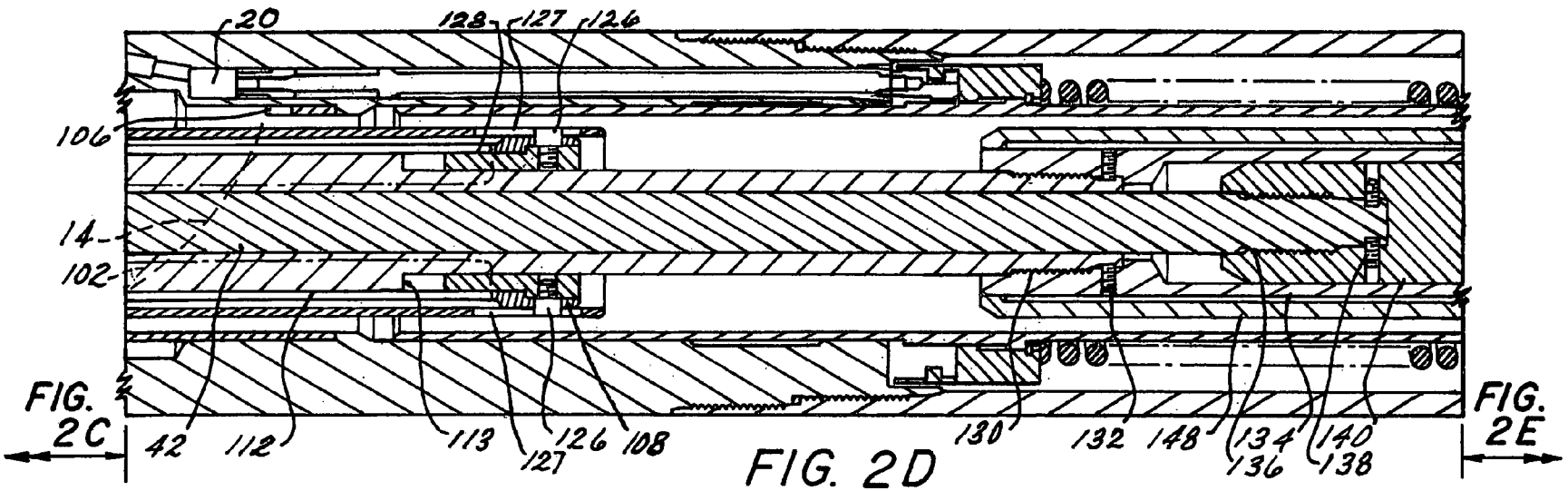
Figure 3D:
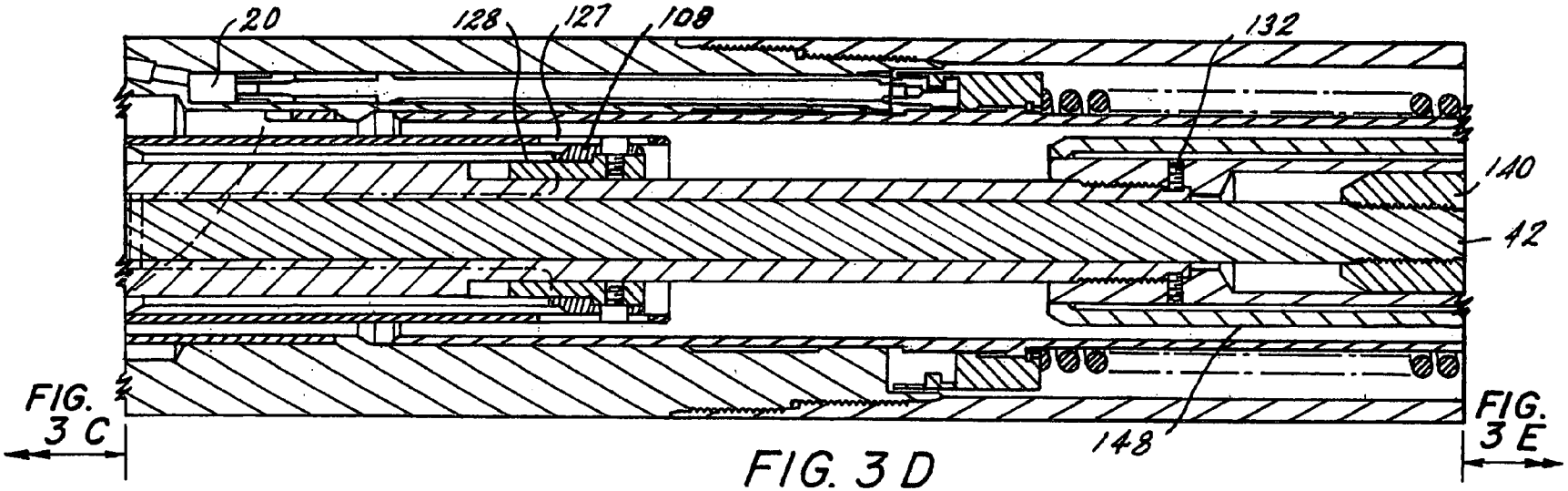
Figure 13:
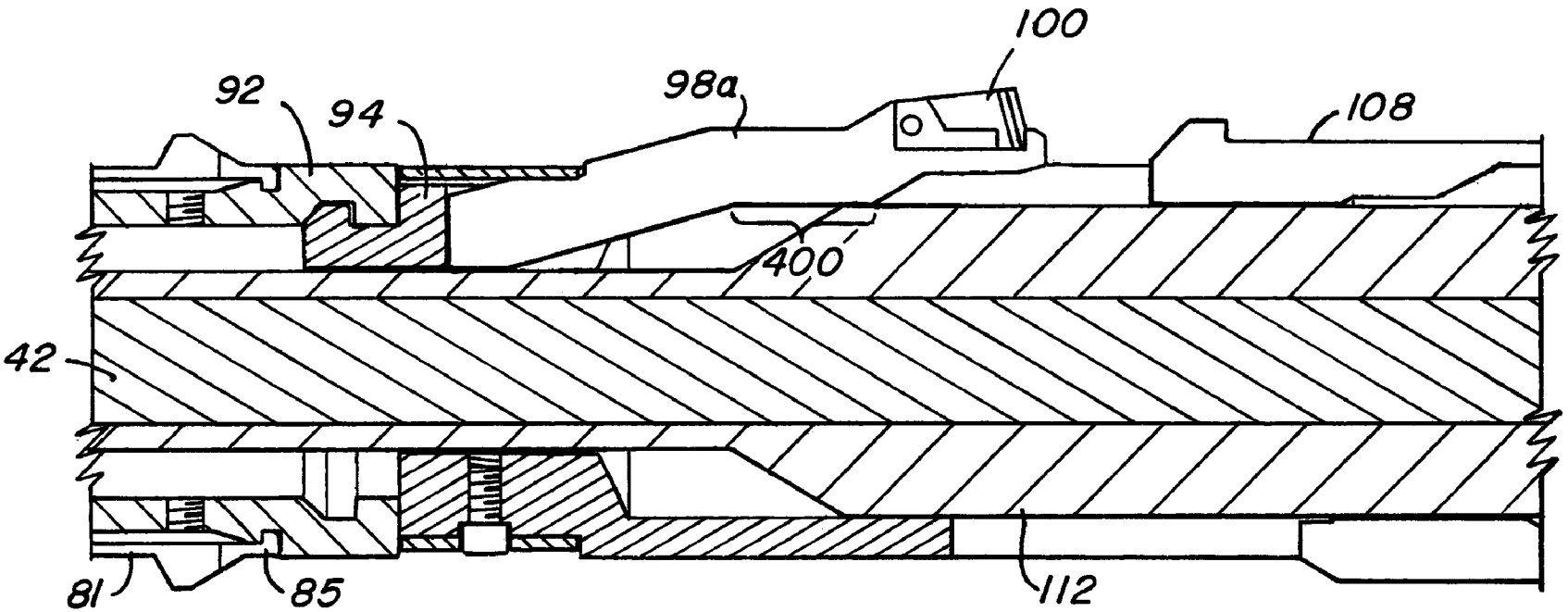
FIGS. 13-16 illustrate alternate components for certain components illustrated in FIGS. 2A-G to FIGS. 11A-G.

In one alternate component the cutter dog 98 represented in FIG. 2C is modified to slide upon the outside dimension of the mandrel 112. Cutter dog 98*a* (see FIG. 13) is formed to include slide area 400, which has an angle calculated to match an outside dimension of the mandrel 112 relative to the angle of the cutter. This area 400 slides upon the outside dimension of mandrel 112 during use. The arrangement provides for greater stability of the cutter dog 98*a*, as a greater percentage of the surface area of the dog remains supported throughout its motion. This may be beneficial in some applications. In other respects the tool operates as above described.

Figure 2E:
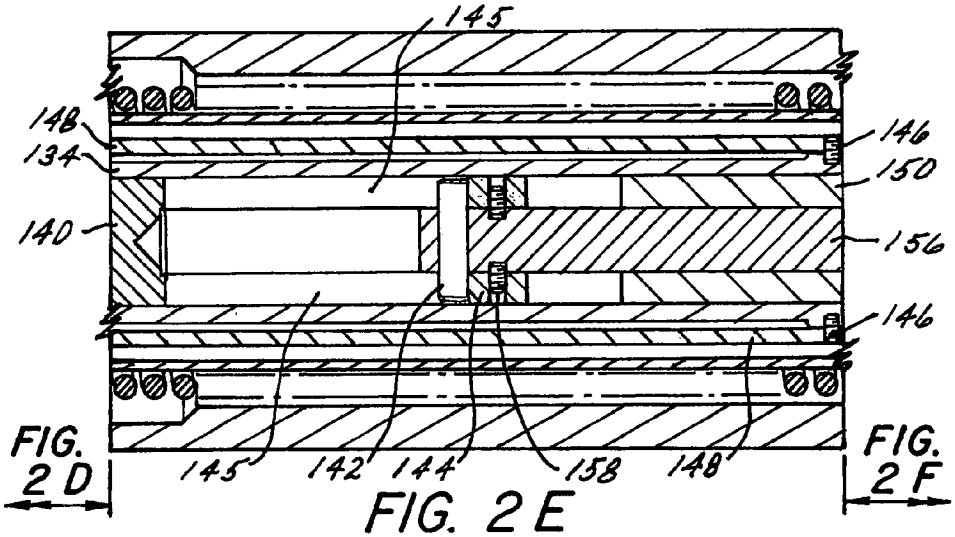
Figure 3E:
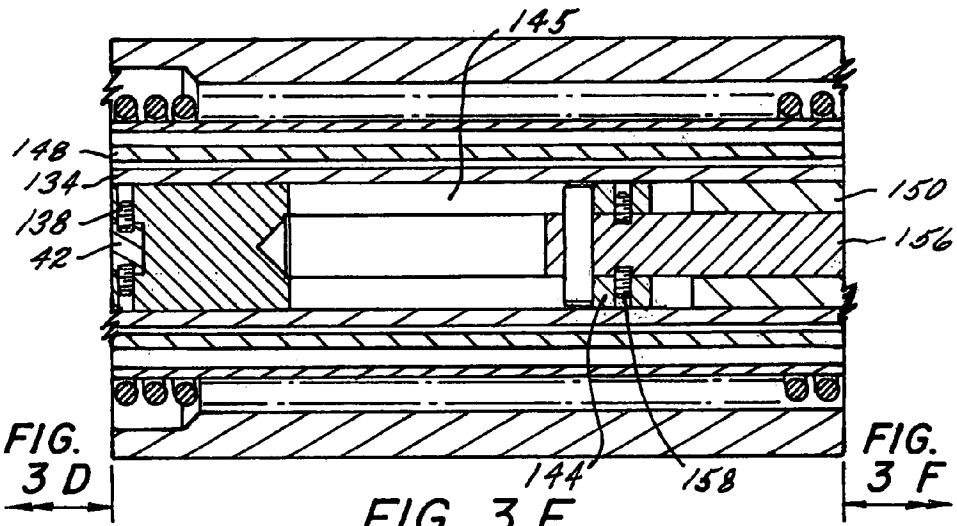
Figure 14:
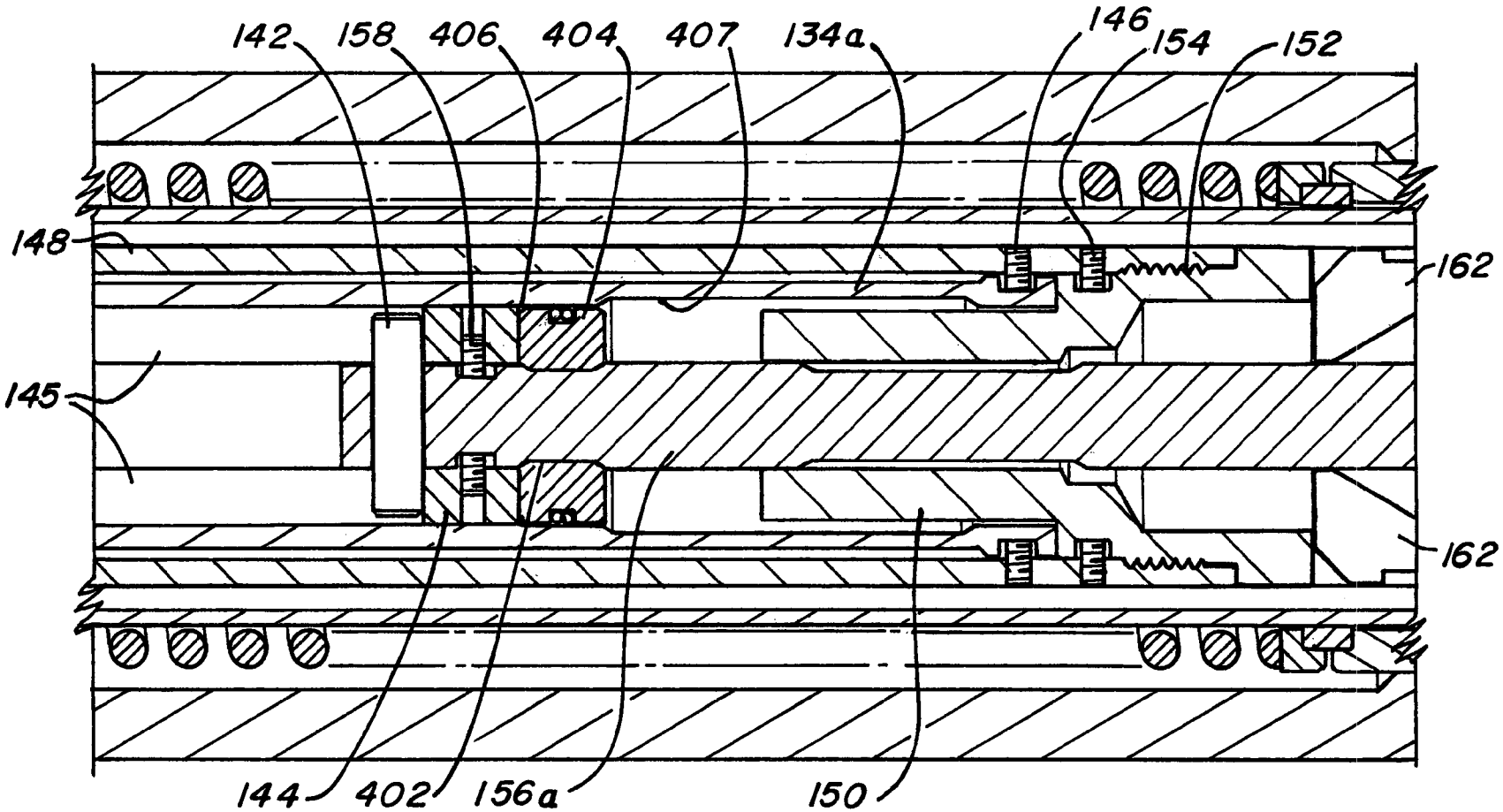

In another alternate component, the lower shaft 156 introduced in FIG. 2E is modified and illustrated in FIG. 14 as lower shaft 156*a*. A set of segments 404 are located such that they engage a recess 402 while remaining in contact with slide 140 at interface 406. Segments 404 are maintained in the engaged position by the inside dimension of inner sleeve 134. A relief 407 is provided in the inside dimension of inner sleeve 134*a* to allow the segments 404 to move outwardly and disengage recess 402 in lower shaft 156*a*. Once disengaged, the operation of the device is as disclosed hereinabove.

This alternate construction allows the tool to sustain an impact load on the lower shaft while the tool is being run downhole without premature shearing of the shear screws 158.

Figure 2F:
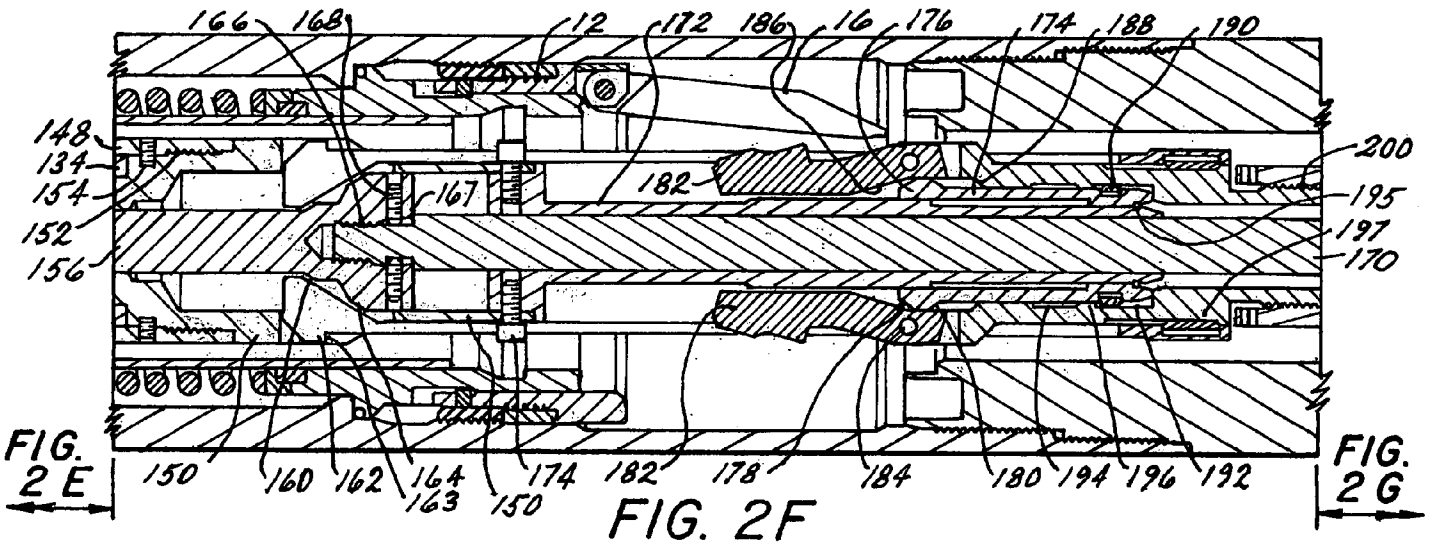
Figure 3F:
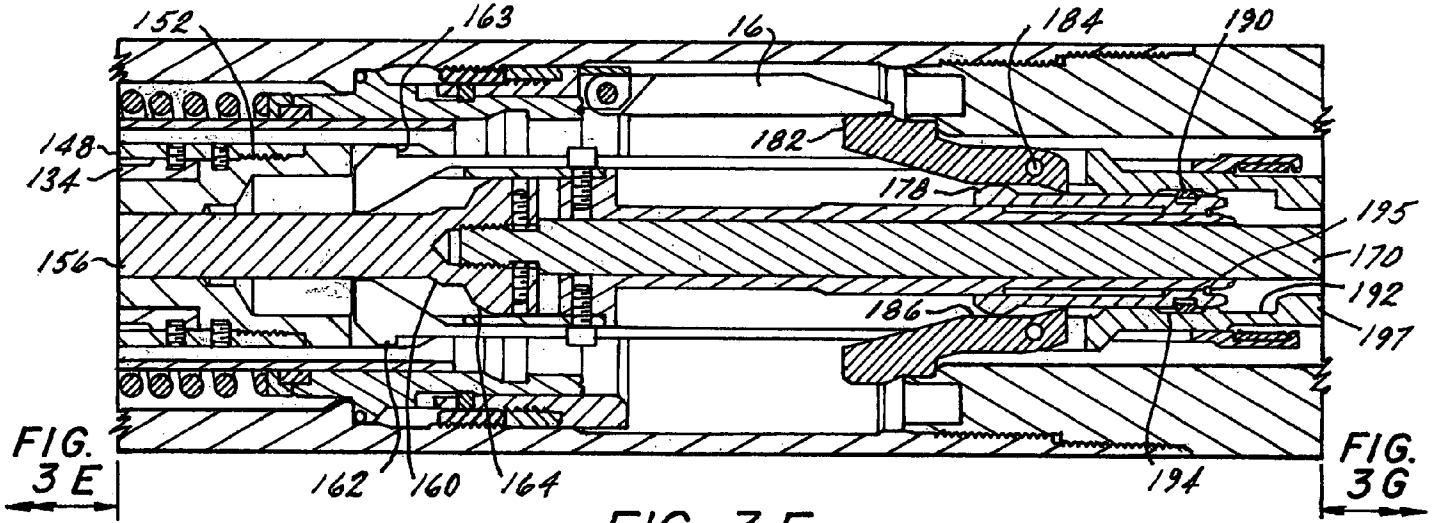
Figure 15:
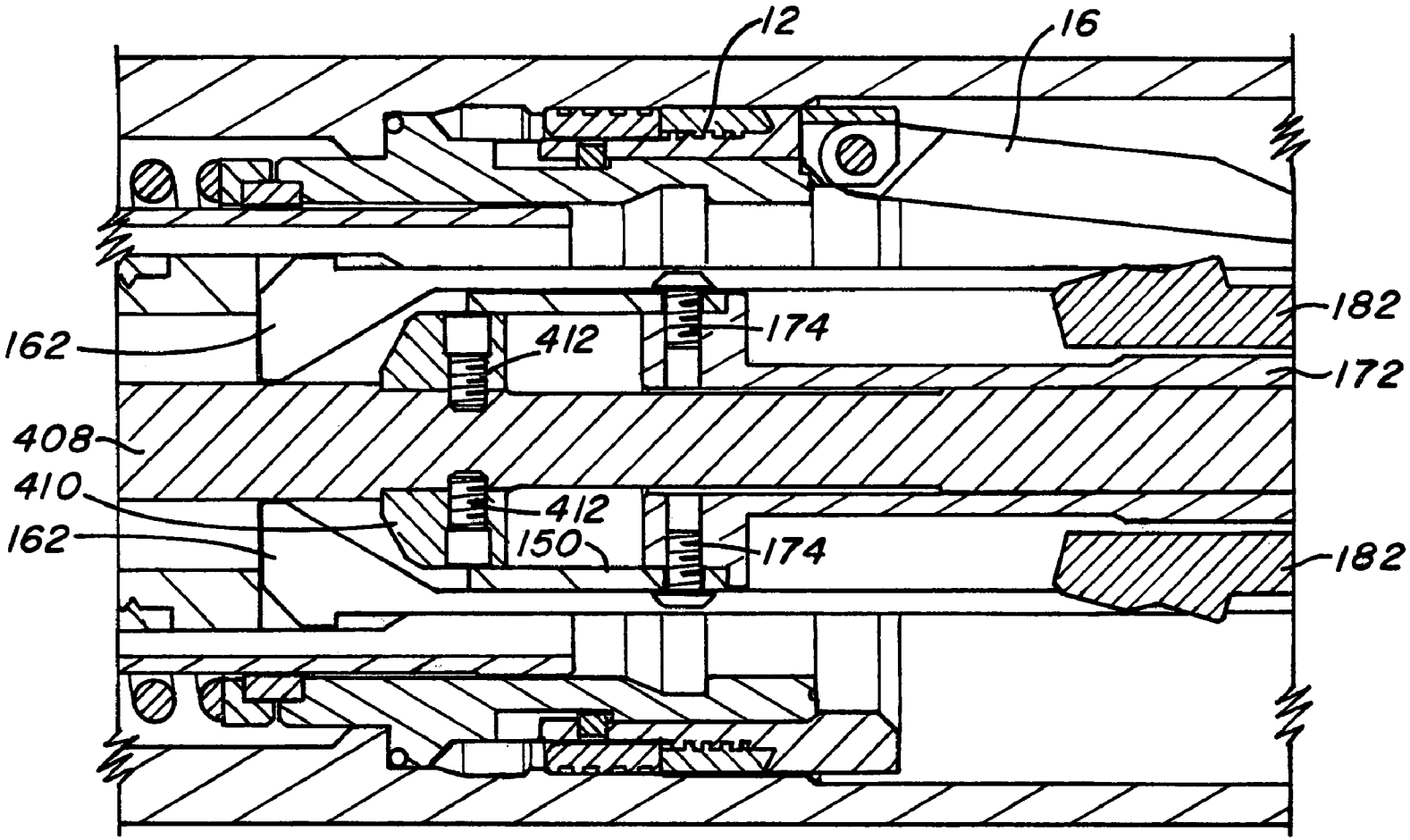

Yet another component, referring to FIG. 15, modifies lower shaft 156 and lower shaft extension 170 as those components are illustrated in FIG. 2K As above described, and illustrated in FIG. 2F, lower shaft 156 is threadedly attached to lower shaft extension 170. Set screws 168 are also employed to prevent relative rotation of the two parts. Illustrated in FIG. 15, the lower shaft 156 and lower shaft extension 170 are replaced by an extended lower shaft 408. Shaft 408 includes a collet support 410, which is attached to shaft 408 by shear members 412. Collet support 410 provides the angle that was previously provided by surfaces 160 and 164 in FIG. 2F. Therefore it will be appreciated that the purpose of collet support 410 is too urge lower latch collet 162 outwardly at an appropriate time in the operation of the device. As noted above, collet support 410 is attached to shaft 408 by shear members 412 such as shear screws and therefore can be detached from shaft 408 if desired by placing a load of sufficient predetermined magnitude on the shear screws to shear them. This is of importance when and if the tool encounters an impediment to the proper expansion of the latch into its intended groove. Such may occur due to, inter alia, debris or mislocation problems. In such situation it is possible for the tool as described in FIG. 2F to become stuck. The modification detailed in FIG. 15 resolves that potential by allowing the device to continue to function by shearing the screws 412, allowing the extended lower shaft 408 to move relative to the collet support 410.

Figure 2G:
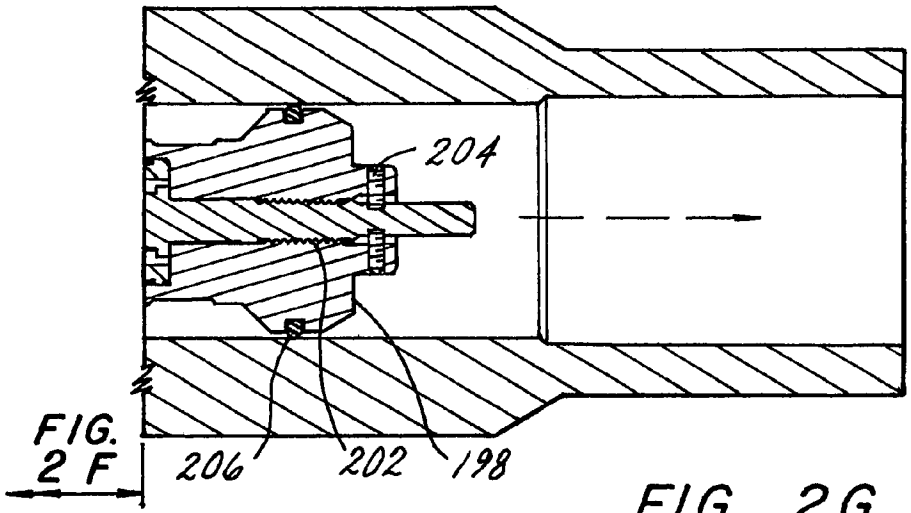
Figure 3G:
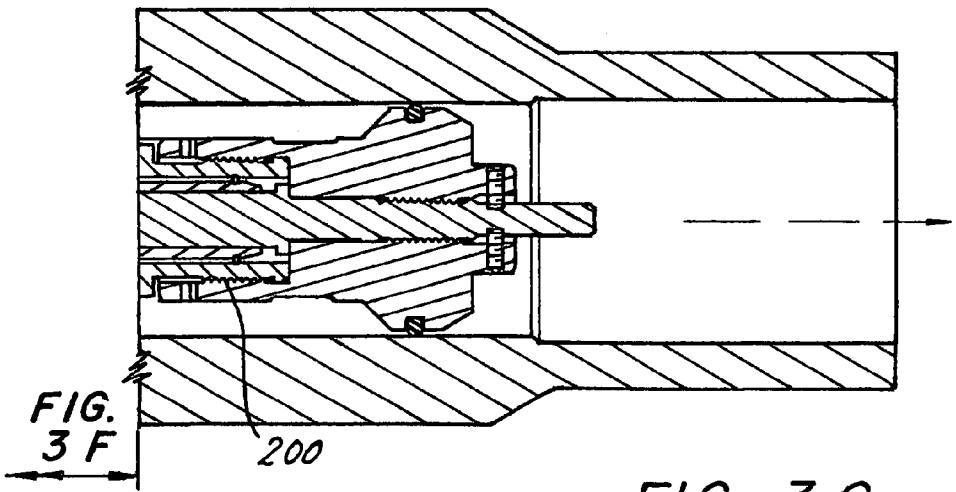
Figure 4A:
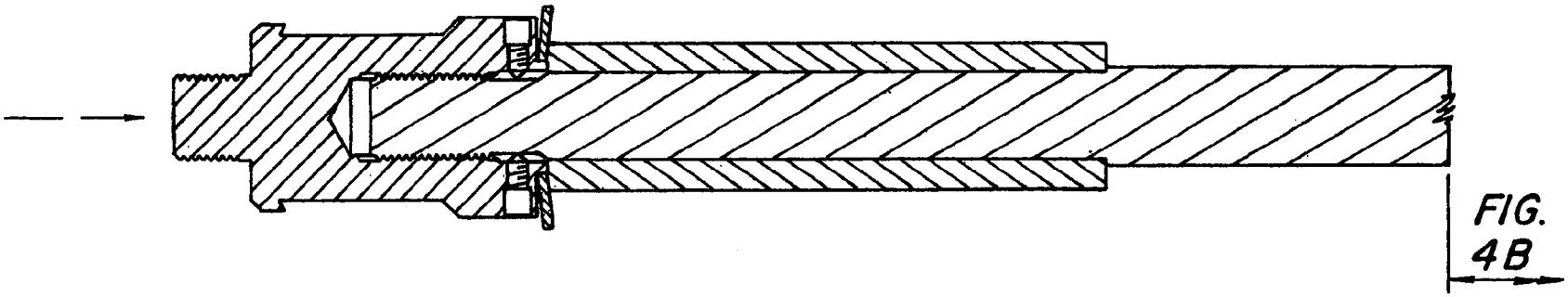
Figure 5A:
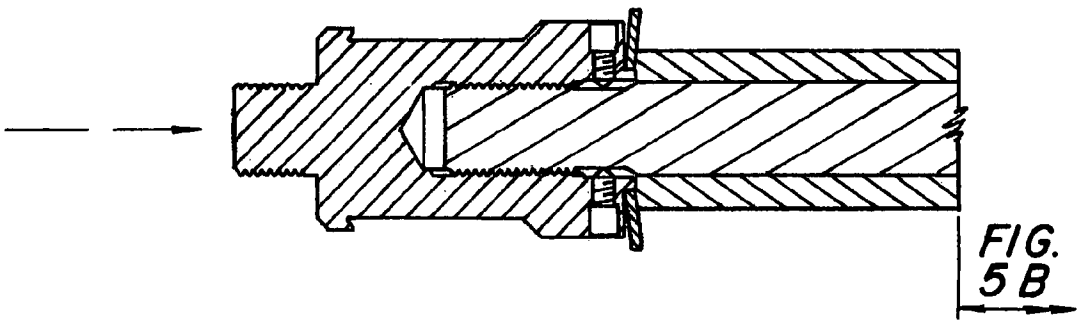
Figure 4B:
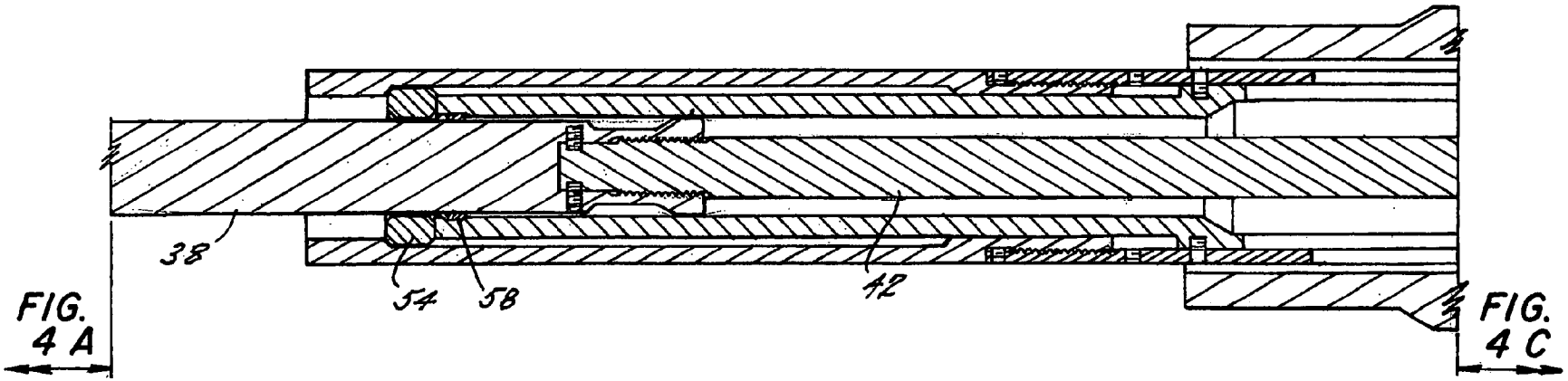
Figure 5B:
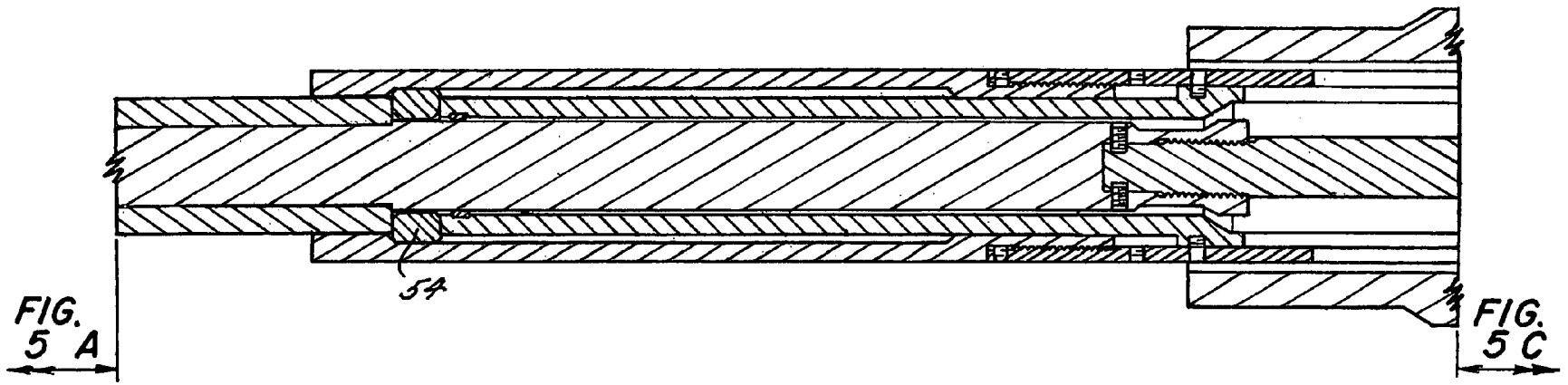
Figure 4C:
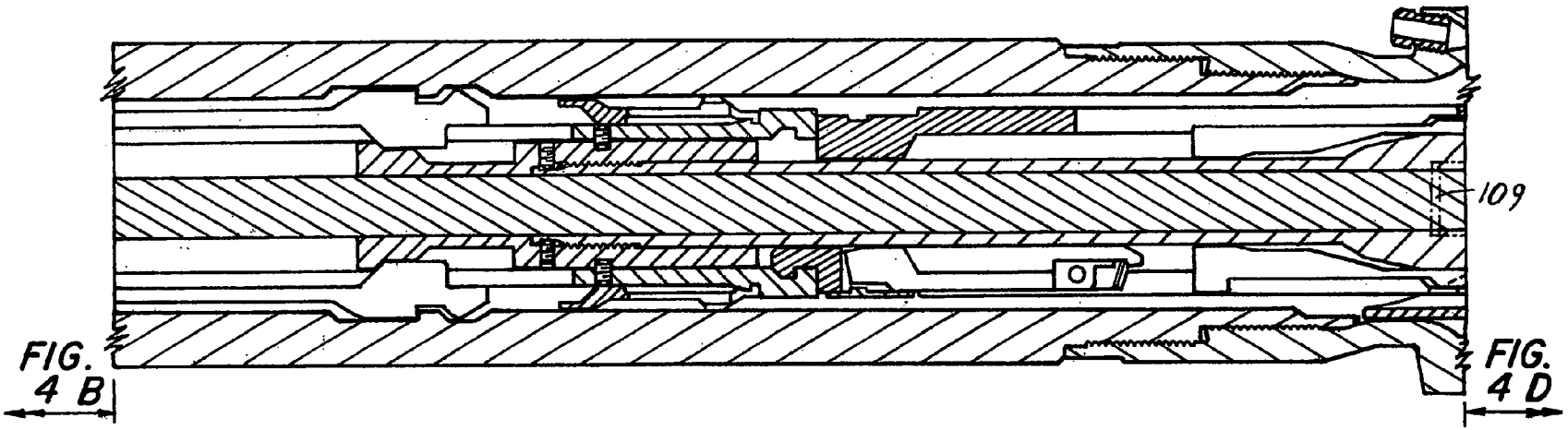
Figure 5C:
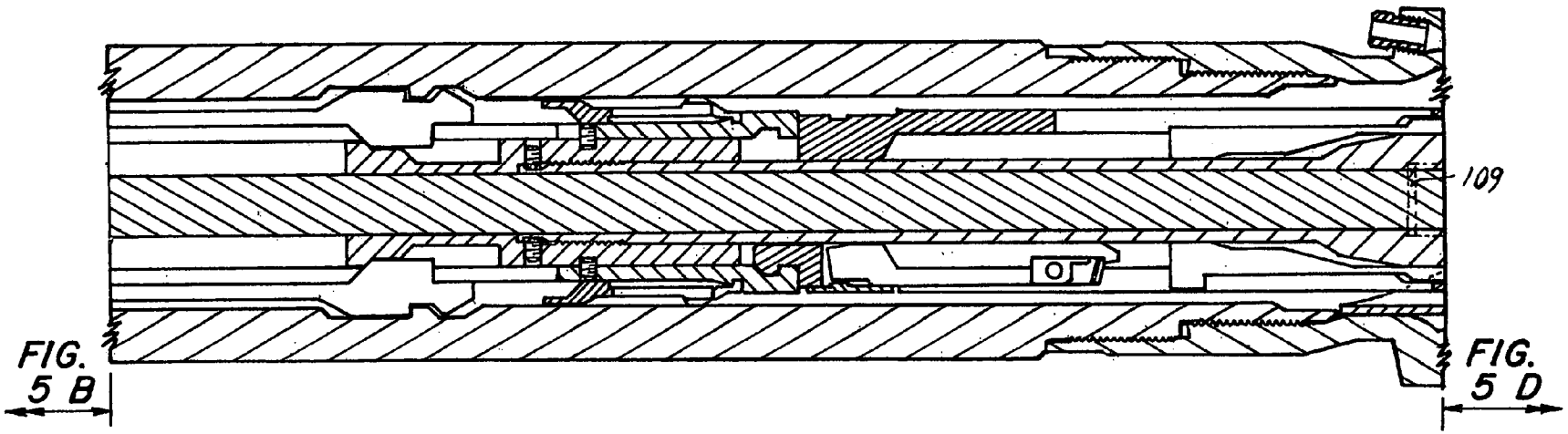
Figure 4D:
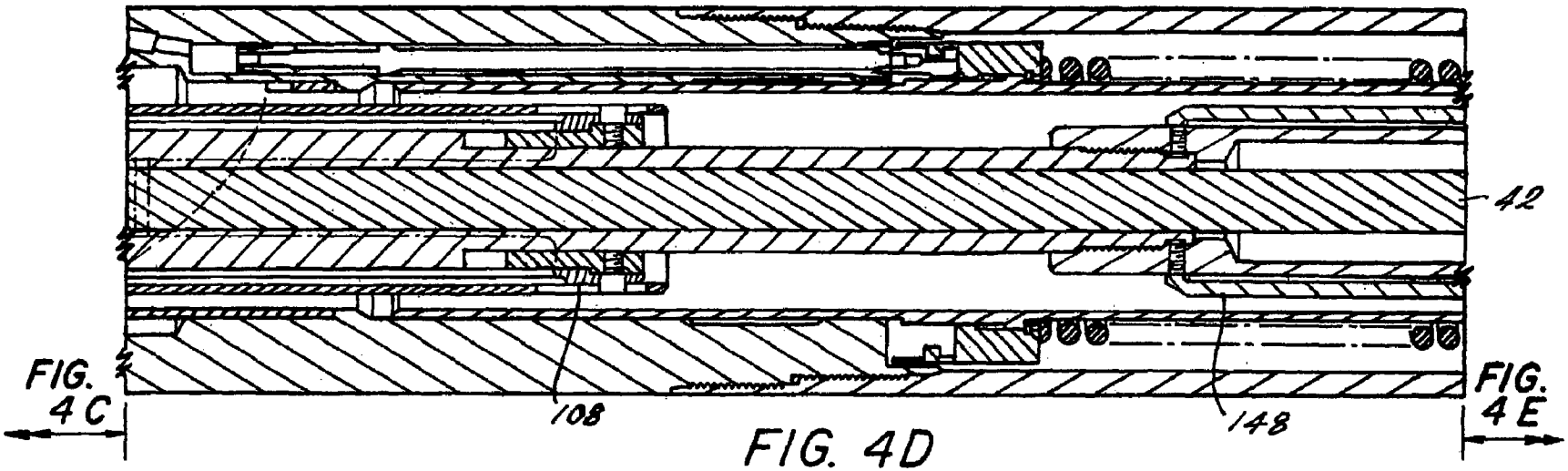
Figure 5D:
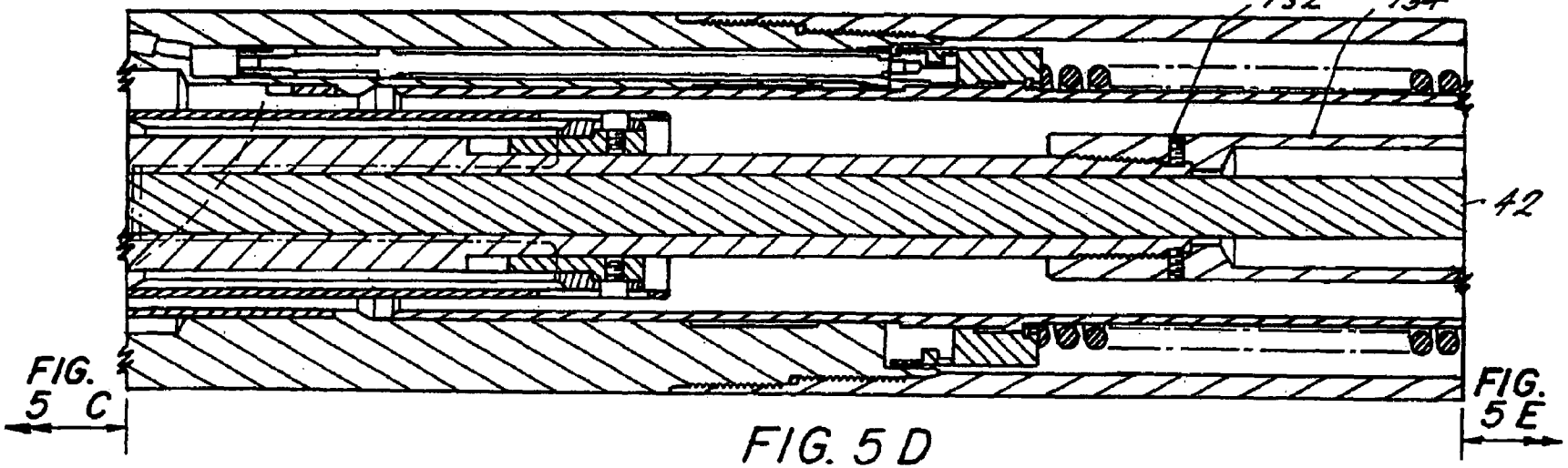
Figure 4E:
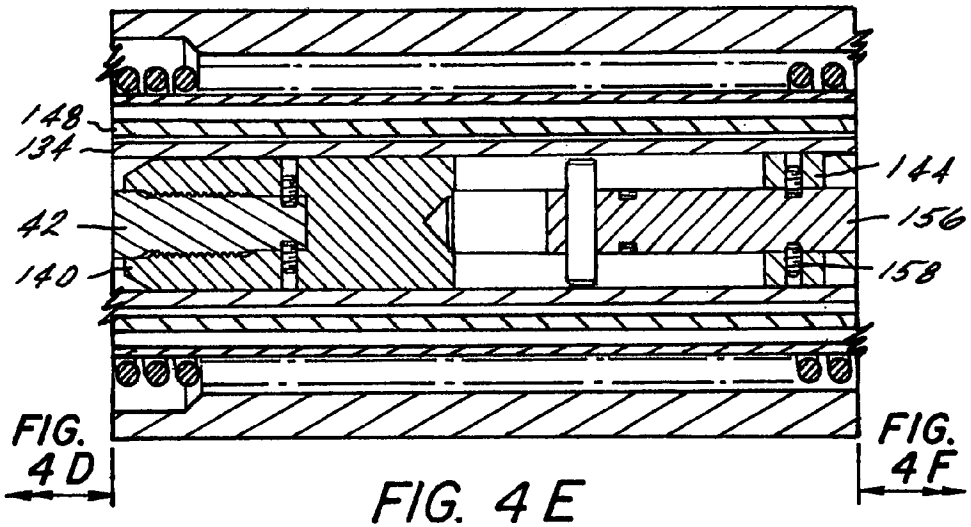
Figure 5E:
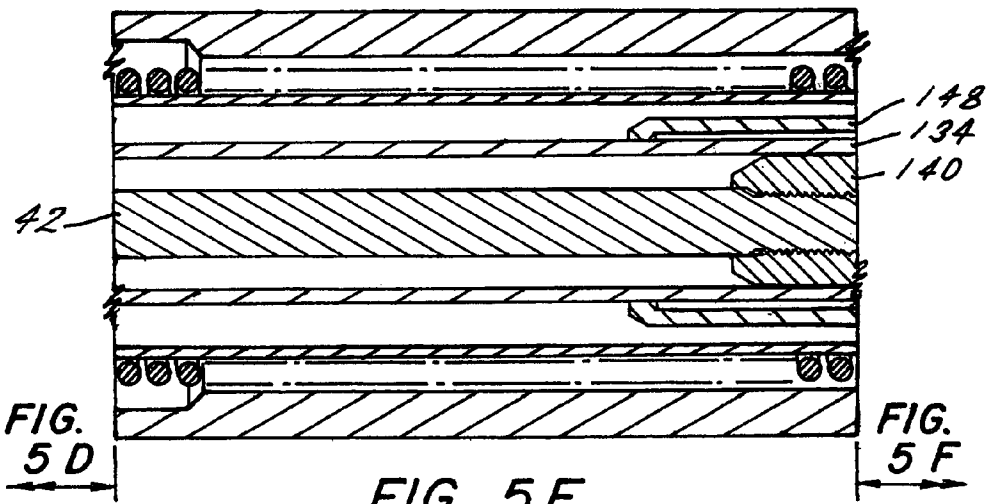
Figure 4F:
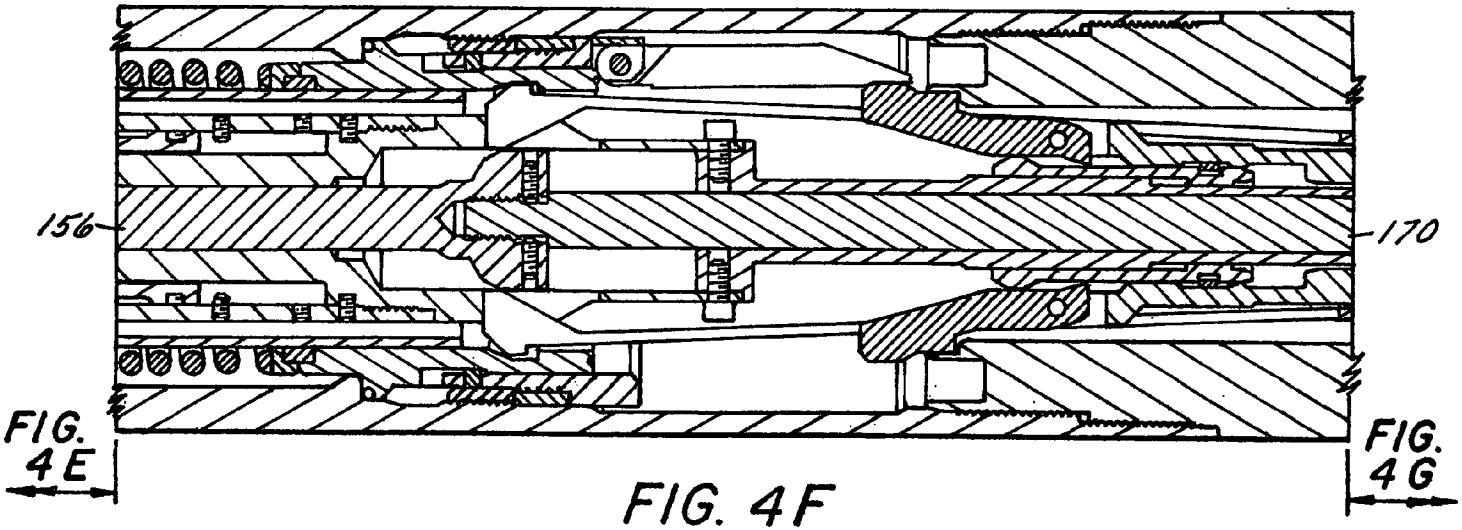
Figure 5F:
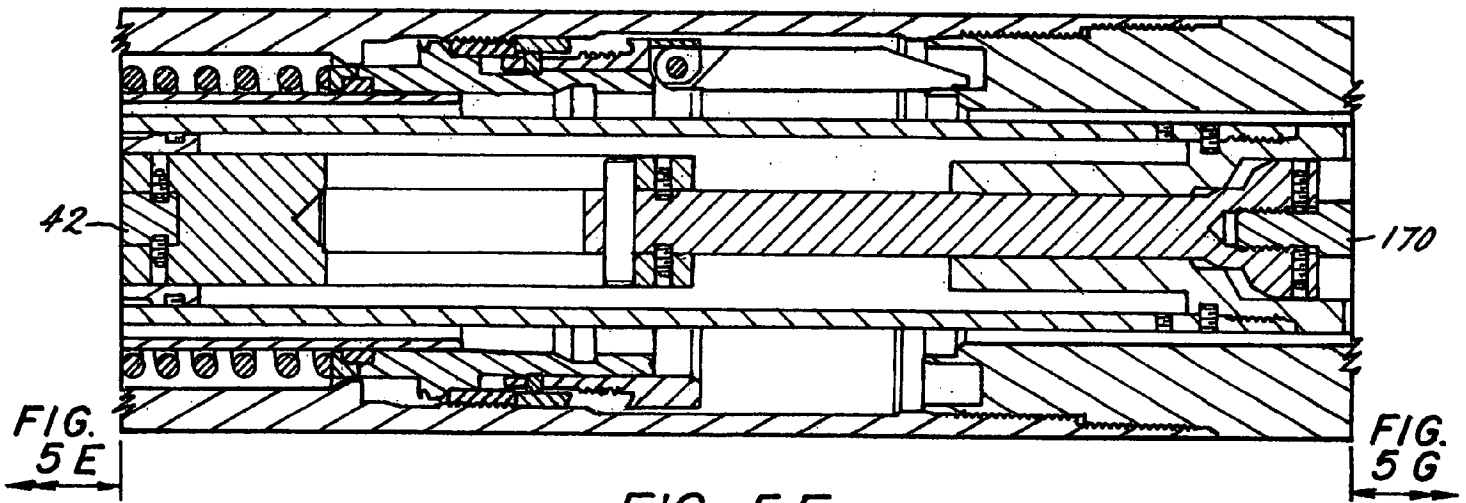
Figure 4G:
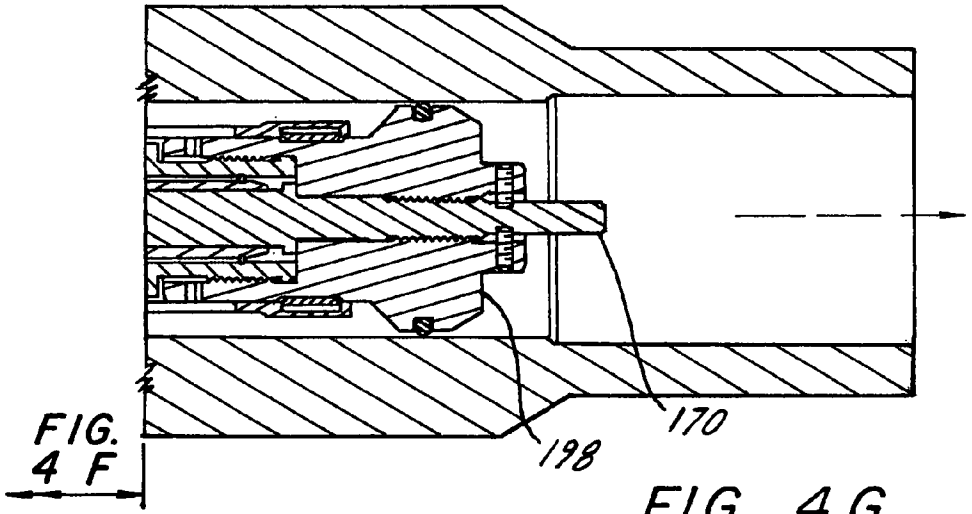
Figure 5G:
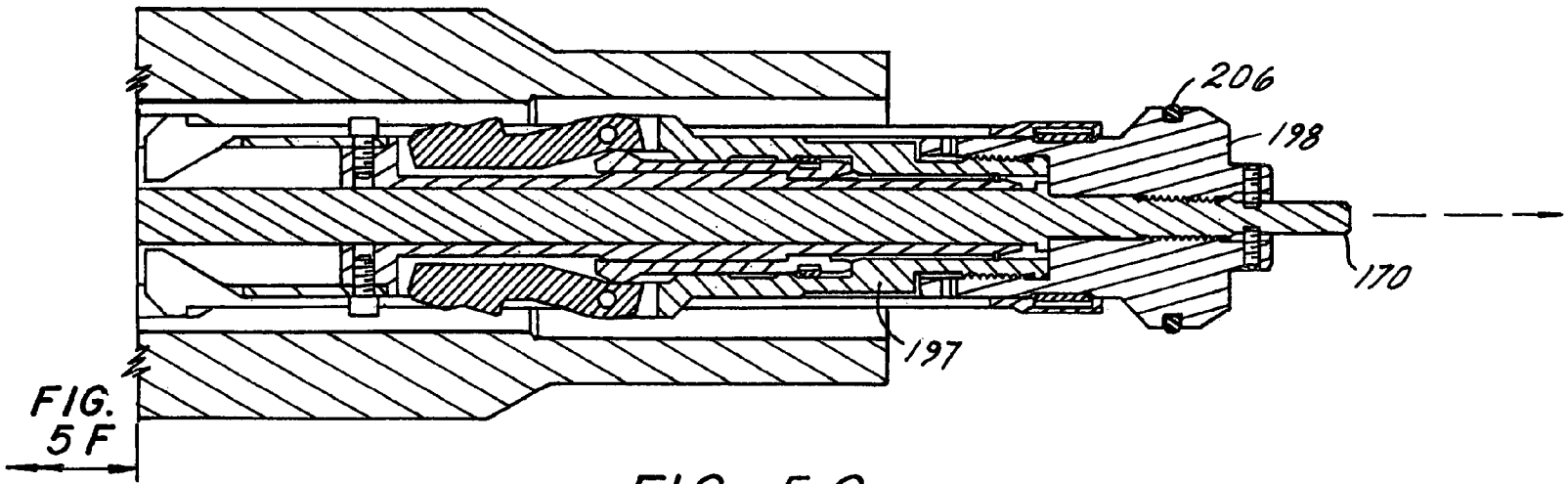
Figure 6A:
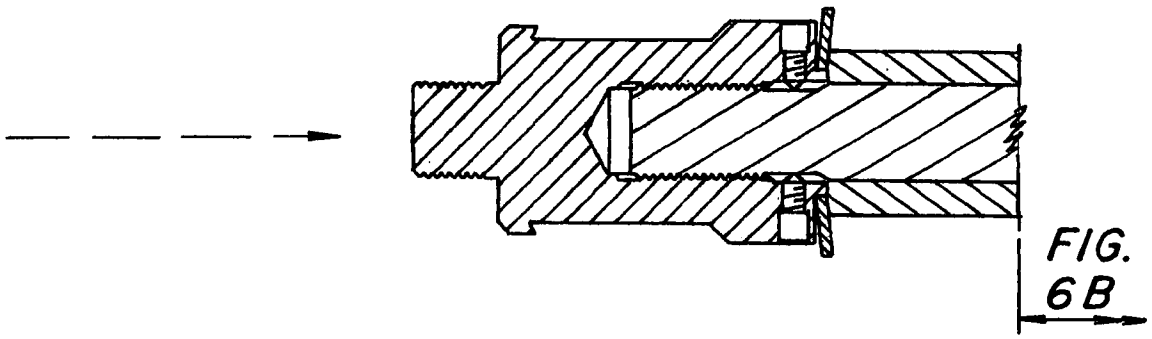
Figure 6B:
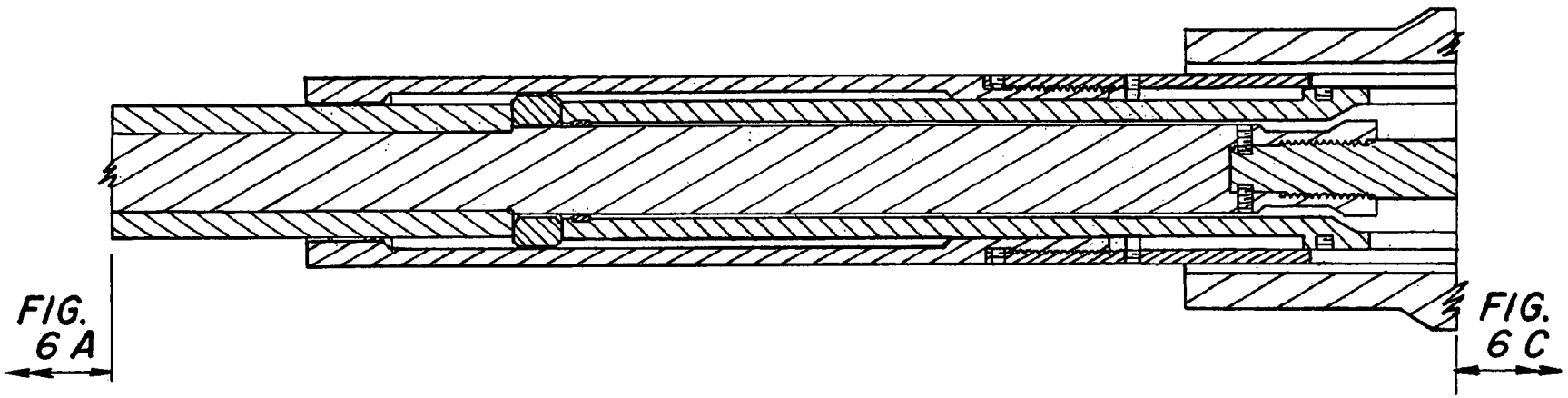
Figure 6C:
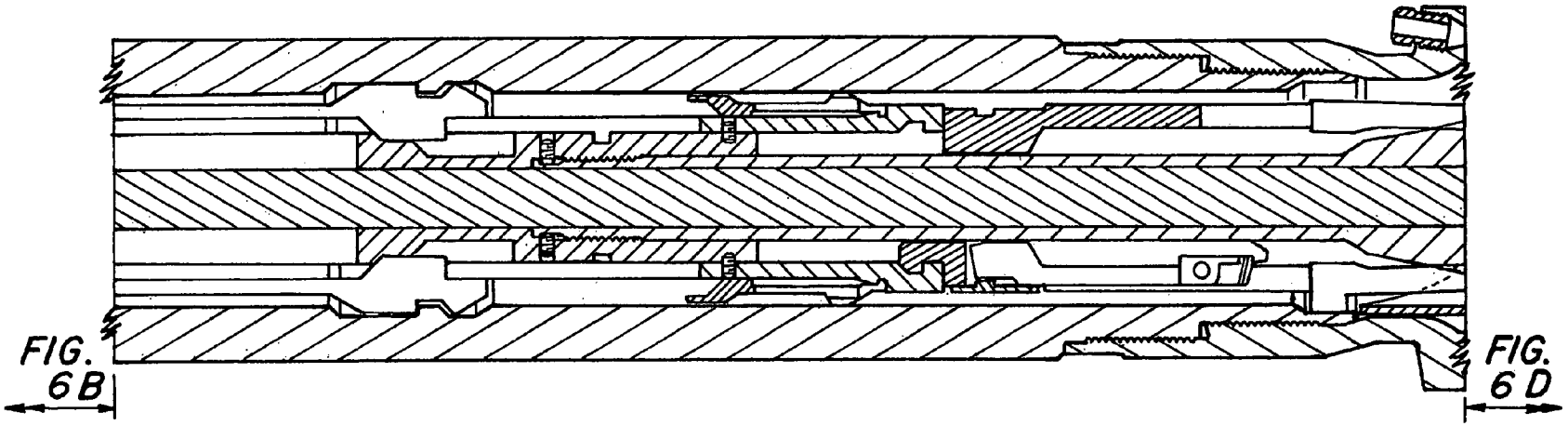
Figure 16:
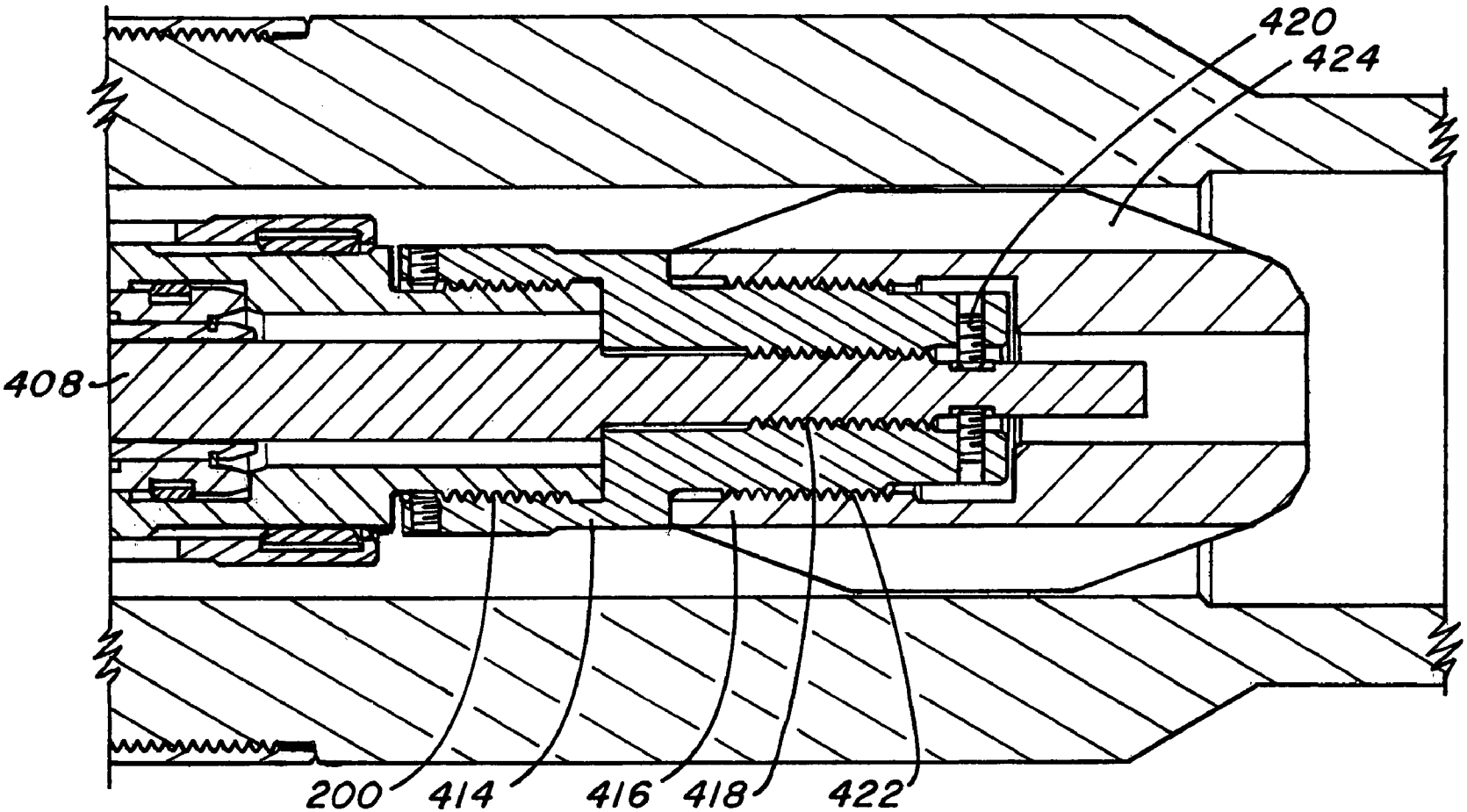

In a final alternate component of that hereinbefore described, and referring to FIG. 16, the cap 198 of FIG. 2G is modified to exist in two parts: a cap mount 414 and a cap head 416. Cap mount 414 is mounted to lower shaft extension 170 or extended lower shaft 408 depending upon which embodiment is utilized. For purposes of discussing the FIG. 16 view, shaft 408 is illustrated with the understanding that either shaft could be used. The mounting is at thread 418 and setscrews 420 ensure prevention of relative motion between these parts. Cap mount 414 retains thread 200 from the previously described embodiment, illustrated in FIG. 3G. The cap mount 414 is attached cap head 416. As illustrated cap head 416 is fastened utilizing thread 422. Cap head 416 includes fluid bypass openings 424 to reduce fluid resistance while running the tool. Also noted is that the cap head may be constructed of brass or other softer material to alleviate seal bore damage as the tool is run in the hole.

It is to be understood that any one component, any group of components or all of these alternate components may be employed with the tool as described earlier in this application.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A communication and lock open device comprising:

a lock open portion including a latch configured to engage a shifting profile on a closure member of a safety valve;

a communication portion configured to rotationally align a cutter with a non-annular hydraulic control bore in the safety valve and cut in the longitudinal direction into the hydraulic control bore with said cutter.

2. A communication and lock open device as claimed in claim 1 wherein the lock open portion further includes locating dogs engageable with the valve to ensure engagement of the latch with the shifting profile and to support the device while shifting the closure member.

3. A communication and lock open device as claimed in claim 1 wherein the communication portion further includes an alignment device configured to engage an alignment profile at the safety valve.

4. A communication and lock open device as claimed in claim 3 wherein the alignment device is operably associated with the cutter such that upon alignment of the alignment device, the cutter is rotationally aligned with the non-annular hydraulic bore.

5. A communication and lock open device as claimed in claim 1 wherein the tool further comprises an upper latch to latch into a profile on the safety valve.

6. A communication and lock open device as claimed in claim 5 wherein the upper latch is engageable by a selective latch to prevent engagement until selected.

7. A communication and lock open device as claimed in claim 6 wherein the selective latch is settable to engage the upper latch thereby preventing engagement of the upper latch into the safety valve until the selective is disengaged from the upper latch by being moved toward a downhole end of the tool.

8. A method for replacing the function of a tubing retrievable safety valve while employing an original control line comprising:

running a communication and lock open tool in a wellbore;

locating the tool in a tubing retrievable safety valve;

shearing a shearable member in the tubing retrievable safety valve to render moveable a closure member of the tubing retrievable safety valve;

shifting the closure member to lock the member in an open position;

orienting a cutter mounted to the communication and lock open tool; and longitudinally establishing fluid communication by cutting in the longitudinal direction into a piston bore of the tubing retrievable safety valve.

9. A method for replacing the function of tubing retrievable safety valve while employing an original control line as claimed in claim 8 further comprising removing the communication and lock open tool.

10. A method for replacing the function of tubing retrievable safety valve while employing an original control line as claimed in claim 8 further comprising running a wireline retrievable safety valve.

11. A method for replacing the function of tubing retrievable safety valve while employing an original control line as claimed in claim 10 further comprising controlling the wireline retrievable safety valve with hydraulic fluid pressure from the original control line.

12. A method for replacing the function of tubing retrievable safety valve while employing an original control line as claimed in claim 10 wherein said running the wireline retrievable safety valve includes setting seals at an uphole and a downhole end of the wireline retrievable safety valve, said seals sealing against a seal bore in the tubing retrievable safety valve.

13. A method for replacing the function of tubing retrievable safety valve while employing an original control line as claimed in claim 8 wherein said shearing includes engaging a profile of the tool on a shifting profile on the closure member and urging the profile downhole to load and shear the shearable member.

14. A method for replacing the function of tubing retrievable safety valve while employing an original control line as claimed in claim 8 wherein said shifting includes having the closure member behind a tab in a tubing retrievable safety valve housing to facilitate the locking of the closure member in the open position.

15. A method for replacing the function of tubing retrievable safety valve while employing an original control line as claimed in claim 8 wherein said orienting the cutter includes:

engaging a profile in the tubing retrievable safety valve with an alignment device;

rotating the alignment device;

rotating the cutter vis-àa-vis the alignment device to a position rotationally aligned with a non-annular hydraulic chamber.

16. A method for replacing the function of tubing retrievable safety valve while employing an original control line as claimed in claim 8 wherein said establishing fluid communication comprises:

driving the cutter into the hydraulic chamber to cut an opening therein.

17. A method for replacing the function of tubing retrievable safety valve while employing an original control line as claimed in claim 16 wherein said driving is axial only.

18. A method for replacing the function of tubing retrievable safety valve while employing an original control line as claimed in claim 16 wherein said driving is axial and radial simultaneously.

19. A downhole communication tool comprising:

a cutter mounted to the tool;

a feature at the tool for orienting the cutter with a selected target at a hydraulic control bore such that the cutter cuts into the bore in the longitude direction relative to a tool which houses the hydraulic bore.

20. A downhole communication tool comprising a cutter configured to axially cut into a hydraulic control bore in a safety valve relative to a longitudinal axis of the safety valve.

21. A method for communication with a pre-existing hydraulic control bore of a safety valve comprising:

running a communication tool to a target location downhole;

aligning a cutter in the tool with a pre-existing hydraulic control bore of the safety valve; and cutting in the longitudinal direction into the hydraulic control bore of the safety valve.

* * * * *